US008690618B2

(12) United States Patent
Takase

(10) Patent No.: US 8,690,618 B2
(45) Date of Patent: Apr. 8, 2014

(54) MARINE VESSEL PROPULSION APPARATUS

(75) Inventor: Hiroaki Takase, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 274 days.

(21) Appl. No.: 13/212,258

(22) Filed: Aug. 18, 2011

(65) Prior Publication Data

US 2012/0094557 A1 Apr. 19, 2012

(30) Foreign Application Priority Data

Oct. 13, 2010 (JP) ..... 2010-230853

(51) Int. Cl.
*B63H 20/08* (2006.01)
*B63H 5/20* (2006.01)
*B63H 5/125* (2006.01)

(52) U.S. Cl.
USPC ..... 440/53

(58) Field of Classification Search
USPC ..... 440/53, 61.61 T, 61 F, 61 R; 248/642, 248/643
See application file for complete search history.

(56) References Cited

U.S. PATENT DOCUMENTS 2,916,007 A * 12/1959 Kiekhaefer ..... 440/52
5,219,306 A * 6/1993 Takahashi ..... 440/52
6,390,863 B1 5/2002 Imanaga
6,419,534 B1 * 7/2002 Helsel et al. ..... 440/52
7,244,152 B1 7/2007 Uppgard

FOREIGN PATENT DOCUMENTS

JP 3159294 U 5/2010
JP 3159586 U 5/2010

OTHER PUBLICATIONS

Takase et al.; "Marine Vessel Propulsion Apparatus"; U.S. Appl. No. 13/212,247, filed Aug. 18, 2011.
Takase et al.; "Marine Vessel Propulsion Apparatus"; U.S. Appl. No. 13/212,256, filed Aug. 18, 2011.
Kimura et al., "Suspension Device for Outboard Motor and Vessel Propulsion Apparatus," U.S. Appl. No. 13/732,555, filed Jan. 2, 2013.
Kadobayashi et al., "Suspension Device for Outboard Motor and Vessel Propulsion Apparatus", U.S. Appl. No. 13/732,559, filed Jan. 2, 2013.

* cited by examiner

*Primary Examiner* — Lars A Olson
*Assistant Examiner* — Anthony Wiest
(74) *Attorney, Agent, or Firm* — Keating & Bennett, LLP

(57) ABSTRACT

A marine vessel propulsion apparatus includes an outboard motor, a transom bracket, a steering shaft, a first mount, a second mount, a tilt bracket, a tilt mechanism, and a steering mechanism. The tilt bracket is attached to a transom via the transom bracket and the steering shaft. The outboard motor is joined to the tilt bracket. The tilt bracket includes a first joint portion joined to the outboard motor via a first mount, a second joint portion joined to the outboard motor via a second mount, and a support portion arranged to support the outboard motor at a height different from heights of the first mount and the second mount.

9 Claims, 30 Drawing Sheets

MARINE VESSEL PROPULSION APPARATUS

BACKGROUND OF THE INVENTION

1. Field of the Invention

The present invention relates to a marine vessel propulsion apparatus.

2. Description of Related Art

A conventional marine vessel propulsion apparatus is described in, for example, U.S. Pat. No. 7,244,152. This marine vessel propulsion apparatus includes a transom mount structure, an intermediate member, an outboard motor, upper mounts, and lower mounts.

The transom mount structure is attached to the transom of a hull. The intermediate member is attached to the transom via the transom mount structure. The intermediate member is attached to the outboard motor via the upper mounts and the lower mounts. The upper mounts and the lower mounts have elasticity. The upper mounts and the lower mounts are housed inside the outboard motor. The propulsive force generated by the outboard motor is transmitted to the intermediate member via the upper mounts and the lower mounts. Vibration of the outboard motor is attenuated by the upper mounts and the lower mounts.

SUMMARY OF THE INVENTION

The inventors of preferred embodiments of the present invention described and claimed in the present application conducted an extensive study and research regarding a marine vessel propulsion apparatus, such as the one described above, and in doing so, discovered and first recognized new unique challenges and previously unrecognized possibilities for improvements as described in greater detail below.

In detail, as described above, vibration of the outboard motor is attenuated by the upper mounts and the lower mounts. For example, by making the upper mounts and the lower mounts soft, the vibration transmissibility can be reduced and transmission of vibration of the outboard motor to the hull can be further minimized. However, if the upper mounts and the lower mounts are soft, the force to hold the outboard motor on the hull (posture holding force of the outboard motor) is reduced. If the posture holding force of the outboard motor is weak, the outboard motor easily wobbles, so that the steering is less smooth. Specifically, when changing the direction of the outboard motor by turning the rudder arranged to steer the marine vessel, the response of the outboard motor can be less than optimal. On the other hand, if the upper mounts and the lower mounts are made hard, the posture holding force of the outboard motor increases, however, the vibration transmissibility increases.

Thus, reduction in vibration transmissibility and an increase in posture holding force of the outboard motor counter each other, so that it is difficult to reduce the vibration transmissibility and increase the posture holding force of the outboard motor provided by the upper mounts and the lower mounts. Further, the upper mounts and the lower mounts are disposed inside the outboard motor, so that the numbers and sizes of the upper mounts and the lower mounts are limited. Therefore, ranges of settable elastic coefficients and contraction amounts, etc., are limited, so that the degree of freedom of the design is small. Therefore, it is more difficult to realize both of a reduction in vibration transmissibility and an increase in posture holding force of the outboard motor.

In order to overcome the previously unrecognized and unsolved challenges described above, a preferred embodiment of the present invention provides a marine vessel propulsion apparatus including an outboard motor, a transom bracket, a steering shaft, a first mount, a second mount, a tilt bracket, a tilt mechanism, and a steering mechanism. The outboard motor is arranged to generate a propulsive force. The transom bracket is arranged to be attachable to the transom of a hull. The steering shaft is joined to the transom bracket, and is arranged turnably around a steering axis extending in the up-down direction. The first mount has elasticity. The second mount has elasticity, and is disposed lower than the first mount. The tilt bracket includes a first joint portion, a second joint portion, and a support portion. The first joint portion is joined to the outboard motor via the first mount. The second joint portion is joined to the outboard motor via the second mount. The support portion is arranged to support the outboard motor at a height different from the heights of the first mount and the second mount. The tilt bracket is joined to the steering shaft. The tilt bracket is arranged turnably around a tilt axis extending horizontally along the right-left direction together with the outboard motor. Further, the tilt bracket is arranged turnably around the steering axis together with the steering shaft and the outboard motor. The tilt mechanism is joined to the steering shaft and the tilt bracket, and is arranged to turn the tilt bracket around the tilt axis with respect to the steering shaft. The steering mechanism is joined to the transom bracket and the steering shaft, and is arranged to turn the steering shaft around the steering axis with respect to the transom bracket.

With this arrangement of the present preferred embodiment of the present invention, the outboard motor is supported by the first joint portion, the second joint portion, and the support portion provided on the tilt bracket. Specifically, the first joint portion is joined to the outboard motor via the first mount, and the second joint portion is joined to the outboard motor via the second mount. The support portion supports the outboard motor at a height different from the heights of the first mount and the second mount. When the tilt mechanism turns the tilt bracket around the tilt axis, the outboard motor turns around the tilt axis together with the tilt bracket. When the steering mechanism turns the steering shaft around the steering axis, the outboard motor turns around the steering axis together with the tilt bracket.

Thus, when the outboard motor turns around either of the steering axis and the tilt axis, the outboard motor and the tilt bracket move integrally, so that the state in which the outboard motor is supported by the first joint portion, the second joint portion, and the support portion is maintained. Therefore, when the outboard motor turns around either of the axes, vibration of the outboard motor is blocked by the first joint portion, the second joint portion, and the support portion. Further, when the outboard motor turns around either of the axes, a propulsive force generated by the outboard motor is transmitted to the hull via the first joint portion, the second joint portion, and the support portion.

In detail, vibration of the outboard motor is blocked by the first mount and the second mount that have elasticity. The propulsive force generated by the outboard motor is transmitted to the first joint portion and the second joint portion from the outboard motor via upper mounts and lower mounts. Further, the propulsive force generated by the outboard motor is transmitted from the outboard motor to the support portion. Thus, the propulsive force is transmitted from the outboard motor to the hull not only via the first mount and the second mount but also via the support portion. In other words, the outboard motor is supported by the first joint portion, the second joint portion, and the support portion, and by providing the support portion, the points of support for the outboard motor are increased.

To transmit a high load only by the first mount and the second mount when the space in which the first mount and the second mount are disposed is narrow, mounts with high elastic coefficients must be used as the first mount and the second mount. However, if the elastic coefficients of the first mount and the second mount are high, vibration of the outboard motor is easily transmitted to the hull. On the other hand, by increasing the points of support for the outboard motor by providing the support portion, the load to be applied to the first mount and the second mount can be reduced. Specifically, displacements of the first mount and the second mount can be minimized. Therefore, as long as determinate displacements are allowed, the elastic coefficients of the first mount and the second mount can be reduced. Accordingly, transmission of vibration of the outboard motor to the hull can be minimized. Further, the support portion is provided, so that even if the elastic coefficients of the first mount and the second mount are reduced, a load with the same magnitude as in the case where the support portion is not provided can be transmitted from the outboard motor to the hull. Further, by providing the support portion, the points of support for the outboard motor are increased, so that the posture holding force of the outboard motor can be increased.

The support portion may support the outboard motor at a height between the first mount and the second mount.

The support portion may be symmetrical about a plane including the steering axis and orthogonal or substantially orthogonal to the tilt axis. In this case, the support portion can support the outboard motor at positions symmetrical about the plane including the steering axis and orthogonal or substantially orthogonal to the tilt axis. Accordingly, the outboard motor can be stabilized.

The outboard motor may include an engine including a crankshaft, and the support portion may include a rear support portion that supports the outboard motor on the side rearward relative to the crankshaft, and a front support portion that supports the outboard motor on the side forward relative to the rear support portion. Specifically, the rear support portion may support the outboard motor on the side rearward relative to the gravity center of the outboard motor, and the front support portion may support the outboard motor on the side forward relative to the gravity center of the outboard motor. In this case, the support portion can support the outboard motor at a plurality of positions separate from each other in the front-rear direction by the rear support portion and the front support portion. Accordingly, the outboard motor can be stabilized.

The support portion may include a lateral support portion arranged to support the outboard motor at a position separate from the first mount and the second mount in the right-left direction. In this case, the first joint portion, the second joint portion, and the support portion can support the outboard motor at a plurality of points separate from each other in the right-left direction. Accordingly, the outboard motor can be stabilized.

The marine vessel propulsion apparatus may further include a third mount having elasticity, and the support portion may support the outboard motor via the third mount. In this case, the outboard motor is supported by the first mount, the second mount, and the third mount. Vibration of the outboard motor is blocked by the third mount in addition to the first mount and the second mount. Further, the propulsive force generated by the outboard motor is transmitted by the third mount in addition to the first mount and the second mount. Therefore, the degree of freedom of the design of the first mount and the second mount can be further increased. Accordingly, transmission of vibration of the outboard motor to the hull can be minimized, and the posture holding force of the outboard motor can be increased.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a first marine vessel propulsion apparatus including an electric motor fixed to the transom bracket and a second marine vessel propulsion apparatus including an electric motor fixed to the steering shaft will be described. The description given below is based on a state in which the outboard motor is in a reference posture. The reference posture is a posture of the outboard motor when the tilting angle of the outboard motor is zero and the steering angle of the outboard motor is zero. The tilting angle of the outboard motor is an angle of the rotational axis (crank axis L1) of the crankshaft with respect to a vertical plane. The tilting angle of the outboard motor 2 when the crank axis L1 extends vertically is zero. The steering angle of the outboard motor is an angle of the rotational axis (rotational axis L2) of the propeller with respect to the center line of the hull. The steering angle of the outboard motor when the rotational axis L2 of the propeller extends in the front-rear direction is zero. A direction toward one side of the front-rear direction (forward direction) is a direction approaching the transom, and the other direction of the front-rear direction (rearward direction) is a direction extending away from the transom.

First Marine Vessel Propulsion Apparatus

First Preferred Embodiment

Figure 1:
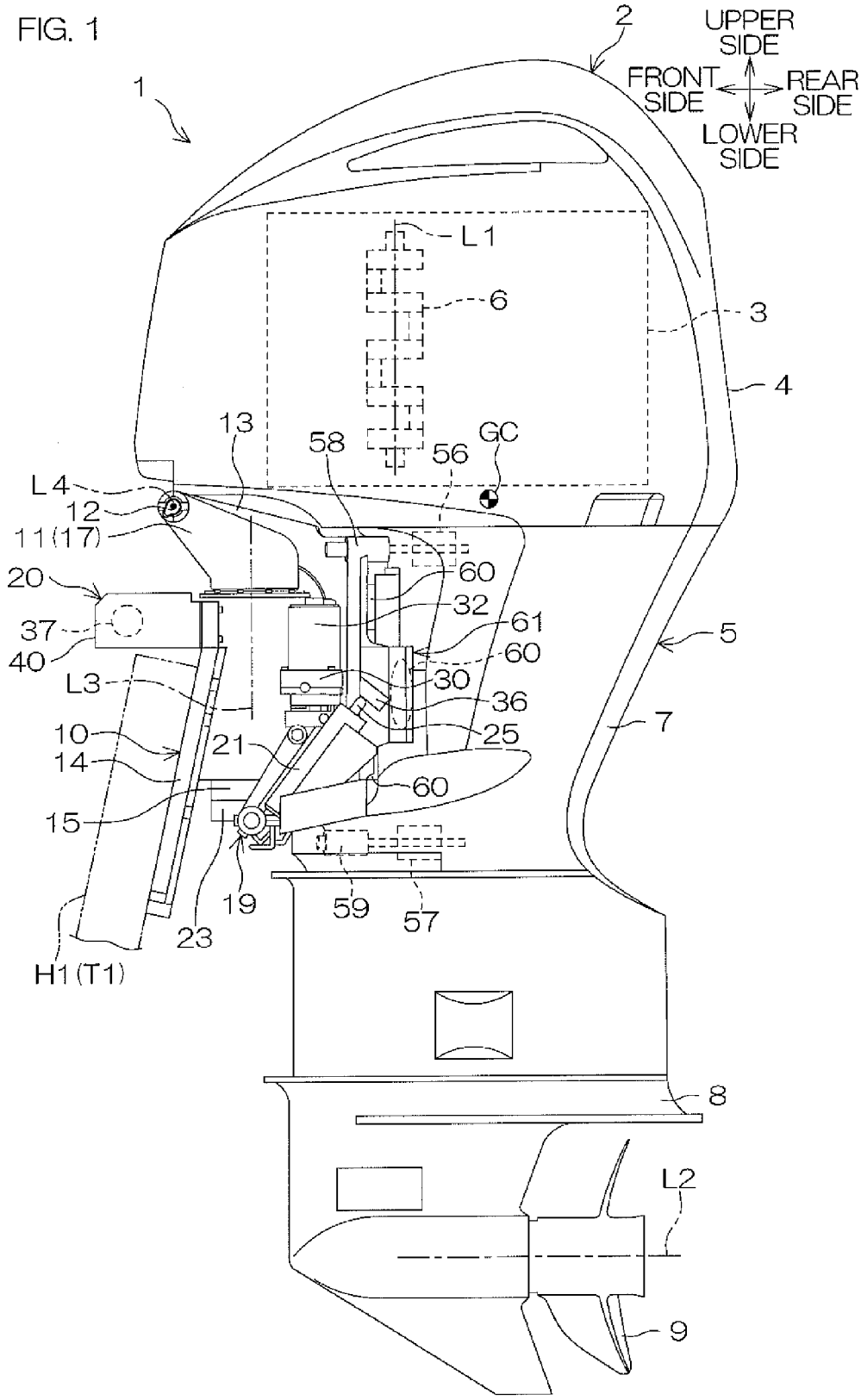
FIG. 1 is a side view of a first marine vessel propulsion apparatus according to a first preferred embodiment of the present invention.
Figure 2:
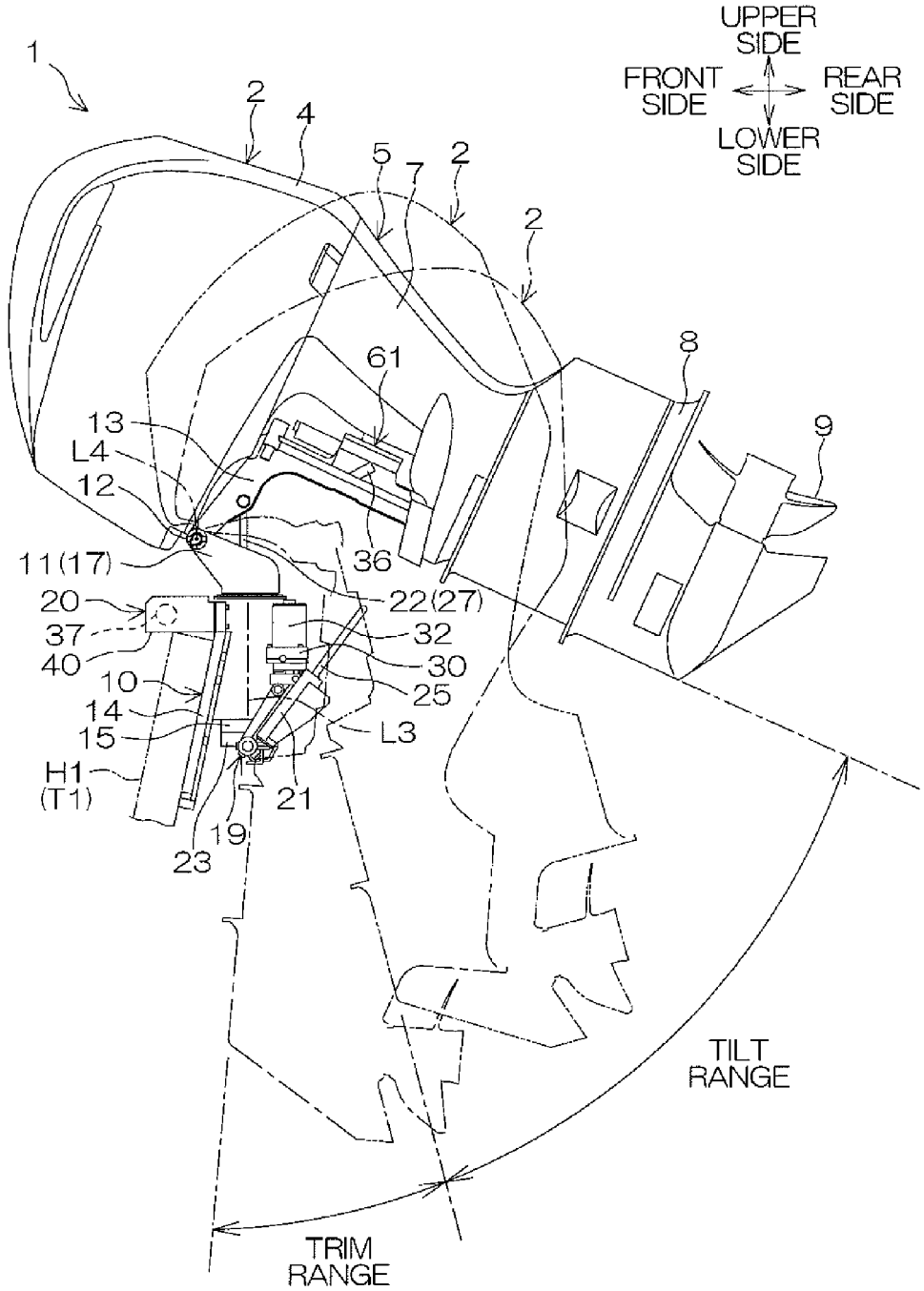
FIG. 2 is a side view of the first marine vessel propulsion apparatus according to the first preferred embodiment of the present invention.
Figure 3:
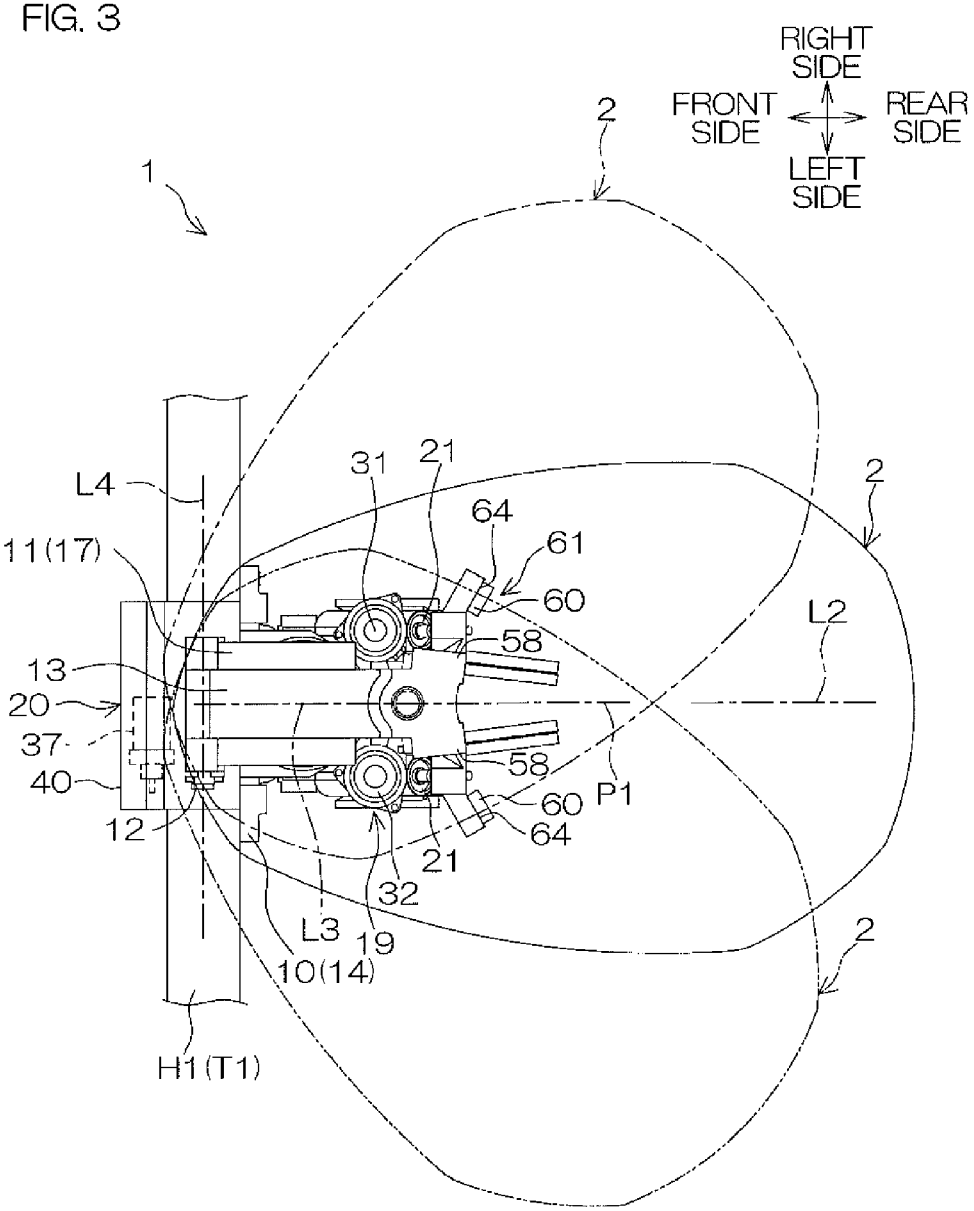
FIG. 3 is a plan view of the first marine vessel propulsion apparatus according to the first preferred embodiment of the present invention.
Figure 4A:
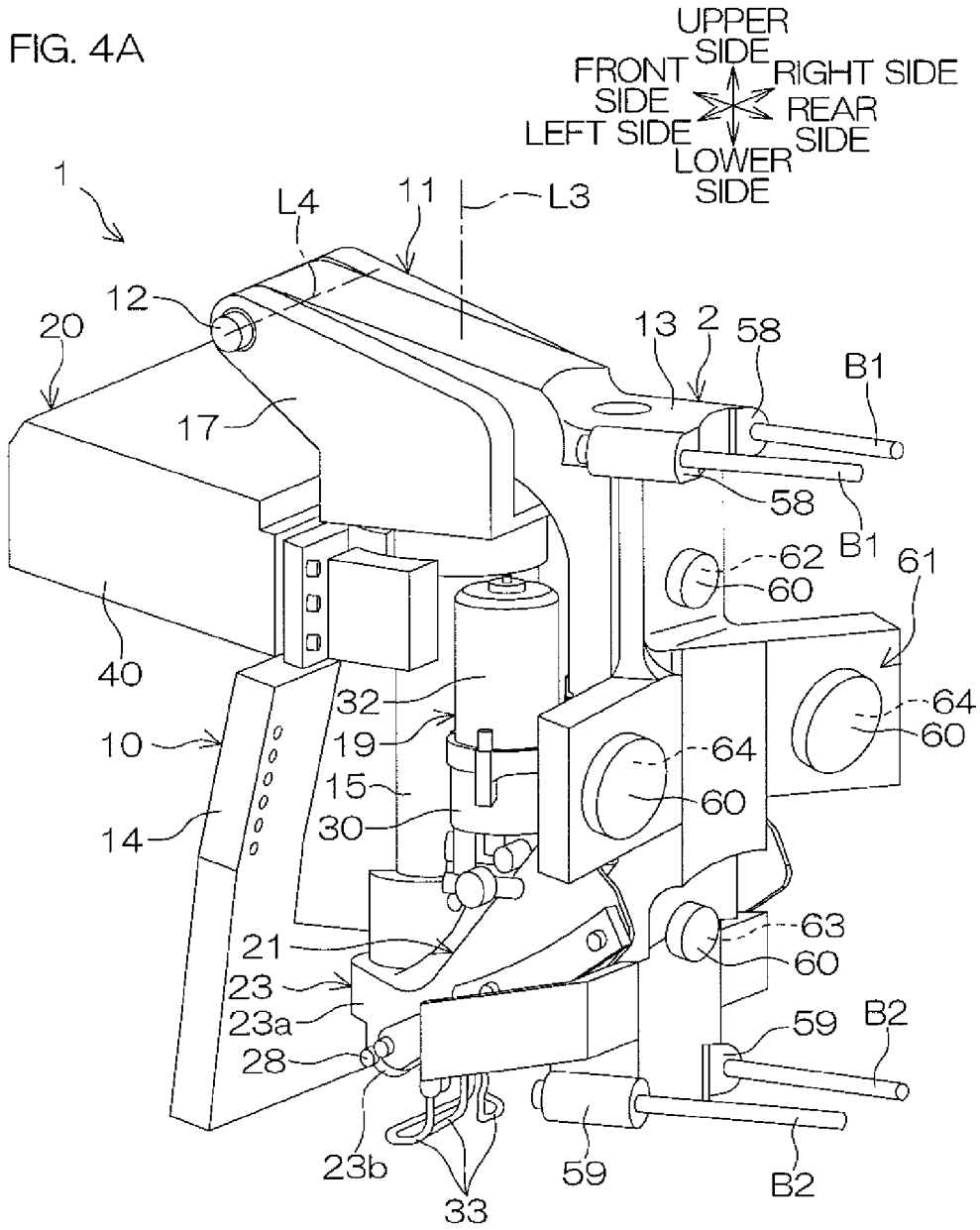
FIG. 4A is a perspective view of a portion of the first marine vessel propulsion apparatus according to the first preferred embodiment of the present invention.
Figure 4B:
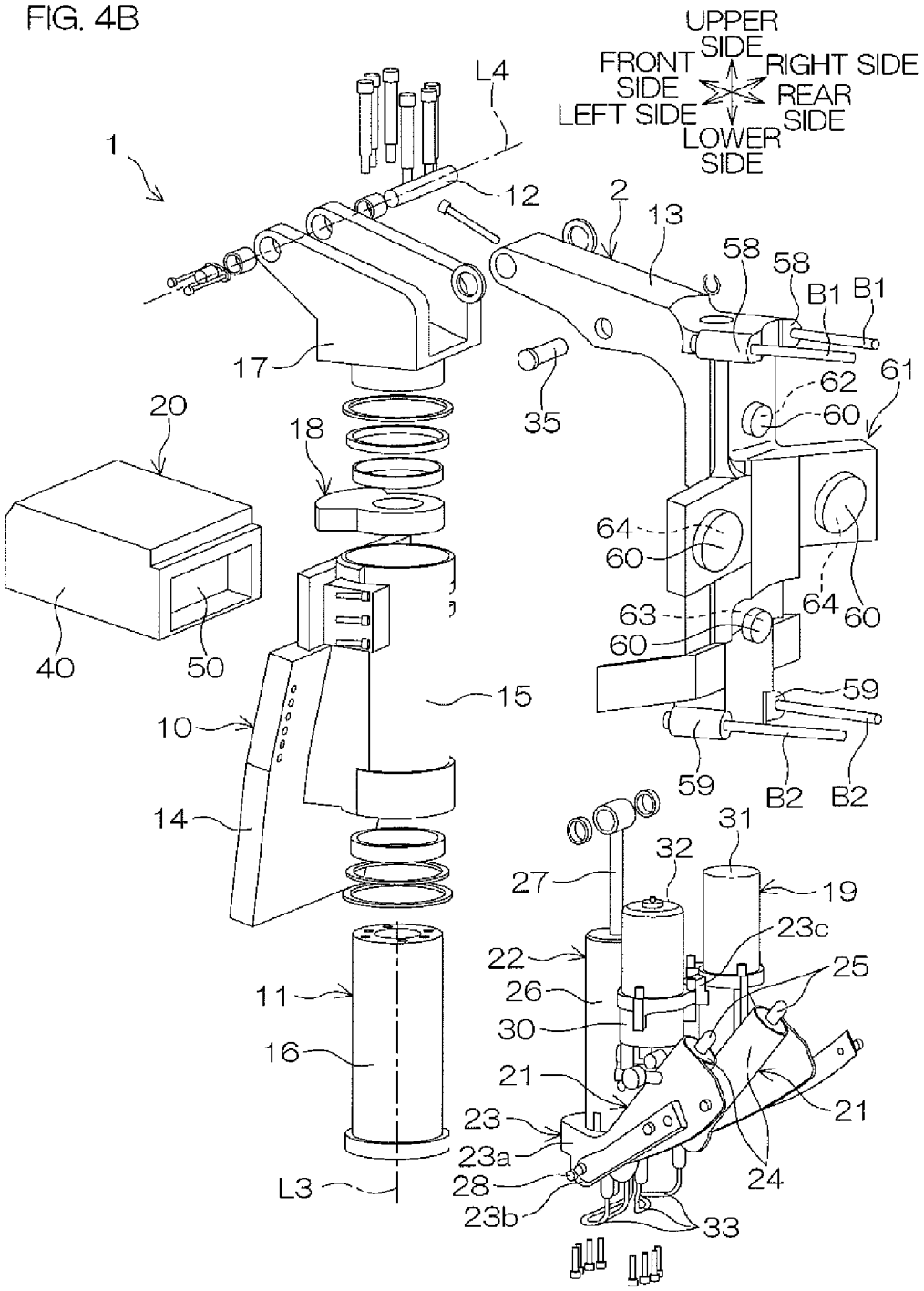
FIG. 4B is an exploded perspective view of a portion of the first marine vessel propulsion apparatus according to the first preferred embodiment of the present invention.
Figure 4C:
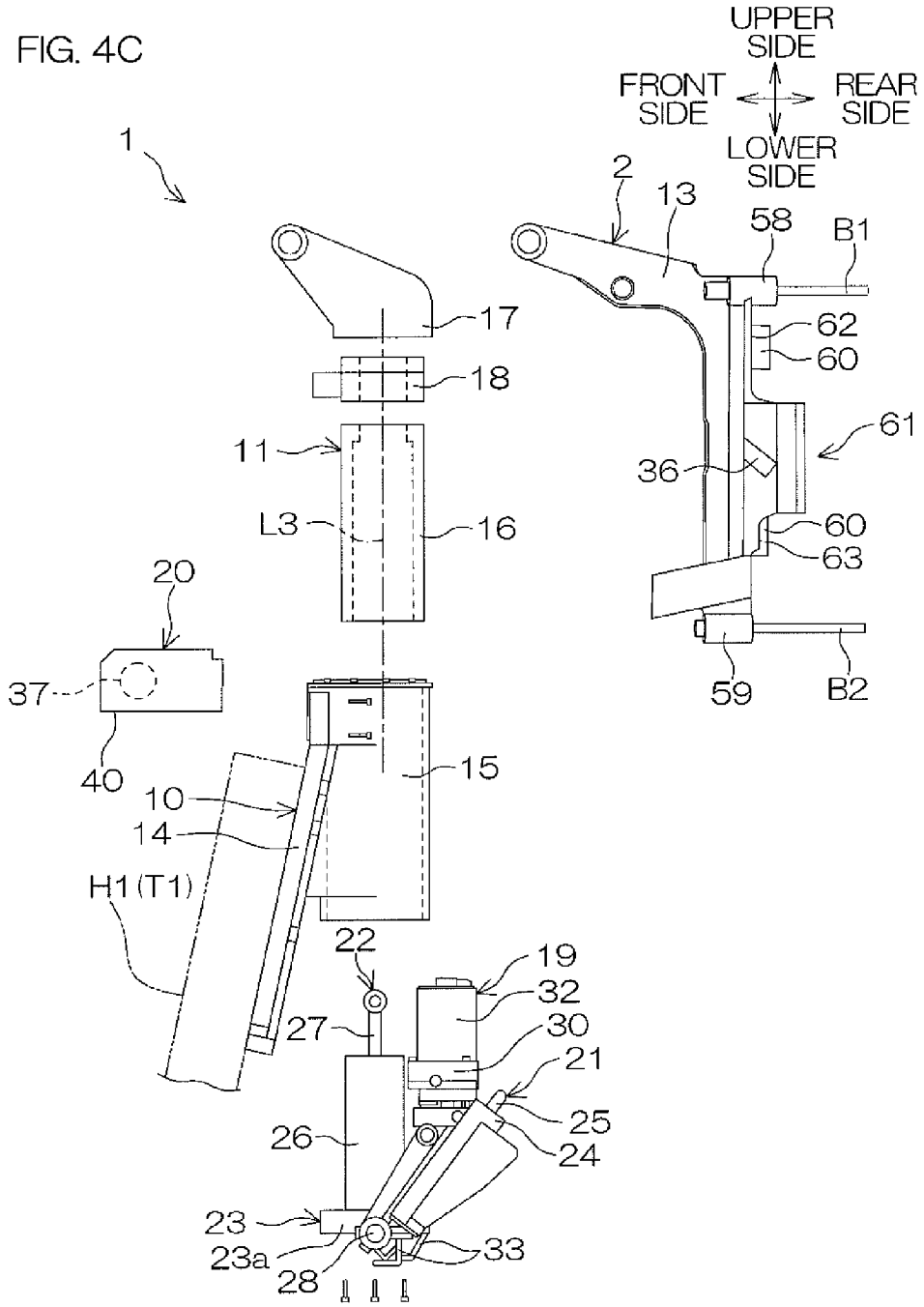
FIG. 4C is an exploded view of a portion of the first marine vessel propulsion apparatus according to the first preferred embodiment of the present invention.

FIG. 1 and FIG. 2 are side views of a first marine vessel propulsion apparatus 1 according to a first preferred embodiment of the present invention. FIG. 3 is a plan view of the first marine vessel propulsion apparatus 1 according to the first preferred embodiment of the present invention. FIG. 4A is a perspective view of a portion of the first marine vessel propulsion apparatus 1 according to the first preferred embodiment of the present invention. FIG. 4B is an exploded perspective view of a portion of the first marine vessel propulsion apparatus 1 according to the first preferred embodiment of the present invention. FIG. 4C is an exploded view of a portion of the first marine vessel propulsion apparatus 1 according to the first preferred embodiment of the present invention. "GC" in FIG. 1 indicates the gravity center of the outboard motor 2.

The first marine vessel propulsion apparatus 1 includes an outboard motor 2. The outboard motor 2 is attached to a transom T1 provided on the rear portion of the hull H1. The outboard motor 2 includes an engine 3, an engine cover 4, and a casing 5. The engine 3 is housed inside the engine cover 4. The engine 3 includes a crankshaft 6. The crankshaft 6 is rotatable around a crank axis L1. The crankshaft 6 is joined to a drive shaft (not shown). The drive shaft is joined to a propeller shaft (not shown). The drive shaft and the propeller shaft are housed in the casing 5. The casing 5 includes an upper case 7 and a lower case 8 disposed below the engine cover 4. The lower case 8 supports the propeller 9 rotatably around a rotational axis L2. Rotation of the crankshaft 6 is transmitted to the propeller 9 via the drive shaft and the propeller shaft. The propeller 9 is rotatable in a forward propelling direction and a backward propelling direction opposite to the forward propelling direction. The propeller 9 is driven to rotate in the forward propelling direction and the backward propelling direction by the engine 3.

The first marine vessel propulsion apparatus 1 includes a transom bracket 10, a steering shaft 11, a tilt shaft 12, and a tilt bracket 13. The transom bracket 10 is attachable to the transom T1. The transom bracket 10 includes a plate-shaped attaching portion 14 to be attached to the transom T1 and a tubular housing portion 15 disposed at the rear of the attaching portion 14. The steering shaft 11 is joined to the transom bracket 10. The tilt bracket 13 is joined to the steering shaft 11 via the tilt shaft 12. Further, the tilt bracket 13 is joined to the outboard motor 2. The steering shaft 11, the tilt bracket 13, and the outboard motor 2 are turnable around a steering axis L3 extending in the up-down direction with respect to the transom bracket 10. The tilt bracket 13 and the outboard motor 2 are turnable around a tilt axis L4 extending horizontally along the right-left direction with respect to the transom bracket 10 and the steering shaft 11. The tilt axis L4 is the central axis of the tilt shaft 12.

As shown in FIG. 4B and FIG. 4C, the steering shaft 11 includes a tubular portion 16, a joint portion 17, and an intermediate portion 18. The steering axis L3 is the central axis of the tubular portion 16. The joint portion 17 is joined to the upper end portion of the tubular portion 16 via the intermediate portion 18. The tubular portion 16, the joint portion 17, and the intermediate portion 18 may be separate members as in this preferred embodiment, or may constitute an integral member. Specifically, the steering shaft 11 may be a member including a plurality of divided bodies, or may be an integral member. The tilt bracket 13 is joined to the joint portion 17 via the tilt shaft 12. The steering shaft 11 is inserted in the housing portion 15 of the transom bracket 10. The tubular portion 16 is housed in the housing portion 15. The housing portion 15 extends along the steering axis L3. The steering shaft 11 is turnable around the steering axis L3 with respect to the transom bracket 10.

The first marine vessel propulsion apparatus 1 includes a tilt mechanism 19. The tilt mechanism 19 is joined to the steering shaft 11 and the tilt bracket 13. The tilt mechanism 19 turns the outboard motor 2 and the tilt bracket 13 around the tilt axis L4 with respect to the transom bracket 10 and the steering shaft 11. The outboard motor 2 turns around the tilt axis L4 with respect to the steering shaft 11, so that even if the tilting angle of the outboard motor 2 changes, the steering axis L3 does not move. Specifically, the steering axis L3 is an axis that does not move with respect to the transom bracket 10. A direction in which the outboard motor 2 tilts around the tilt axis L4 so that the upper end of the crank axis L1 is positioned forward relative to the lower end of the crank axis L1 is defined as a positive direction. A range in which the tilting angle of the outboard motor 2 is small is a trim range, and a range in which the tilting angle of the outboard motor 2 is larger than the upper limit of the trim range is a tilt range.

In FIG. 2, a state in which the tilting angle of the outboard motor 2 is the lower limit (full trim-in angle) of the trim range is shown by the alternate long and short dashed lines, and a state in which the tilting angle of the outboard motor 2 is the upper limit (full trim-out angle) of the trim range is shown by the alternate long and short dashed lines. In FIG. 2, a state in which the tilting angle of the outboard motor 2 is the upper limit (full trim-up angle) of the tilt range is shown by the solid line. The full trim-in angle is, for example, −5 degrees, and the full trim-out angle is, for example, 15 degrees. The full tilt-up angle is, for example, 65 degrees. The tilt mechanism 19 can hold the outboard motor 2 at an arbitrary position including the trim range and the tilt range. The trim range is a range to be used mainly when adjusting the posture of the hull H1 when the marine vessel is propelled forward, and the tilt range is a range to be used mainly when the marine vessel is moored or runs in shallow water.

The first marine vessel propulsion apparatus 1 includes a steering mechanism 20. The steering mechanism 20 is joined to the transom bracket 10 and the steering shaft 11. The steering mechanism 20 turns the steering shaft 11 and the tilt shaft 12 around the steering axis L3 with respect to the transom bracket 10. The tilt bracket 13, the outboard motor 2, and the tilt mechanism 19 turn around the steering axis L3 together with the steering shaft 11 and the tilt shaft 12 according to turning of the steering shaft 11. The tilt shaft 12 turns around the steering axis L3 together with the outboard motor 2, so that the tilt axis L4 that is the central axis of the tilt shaft 12 turns around the steering axis L3 with respect to the transom bracket 10 according to turning of the outboard motor 2 around the steering axis L3. The position of the outboard motor 2 when the steering angle of the outboard motor 2 is zero is defined as a steering origin. As shown in FIG. 3, the outboard motor 2 is turnable to the right and left around the steering origin (the position shown by the solid line). The steering mechanism 20 turns the outboard motor 2 around the steering axis L3 between a maximum rightward steering position (the position shown by the alternate long and short dashed lines) and a maximum leftward steering position (the position shown by the alternate long and two short dashed lines). The steering mechanism 20 can hold the outboard motor 2 at an arbitrary position between the maximum rightward steering position and the maximum leftward steering position.

Figure 5:
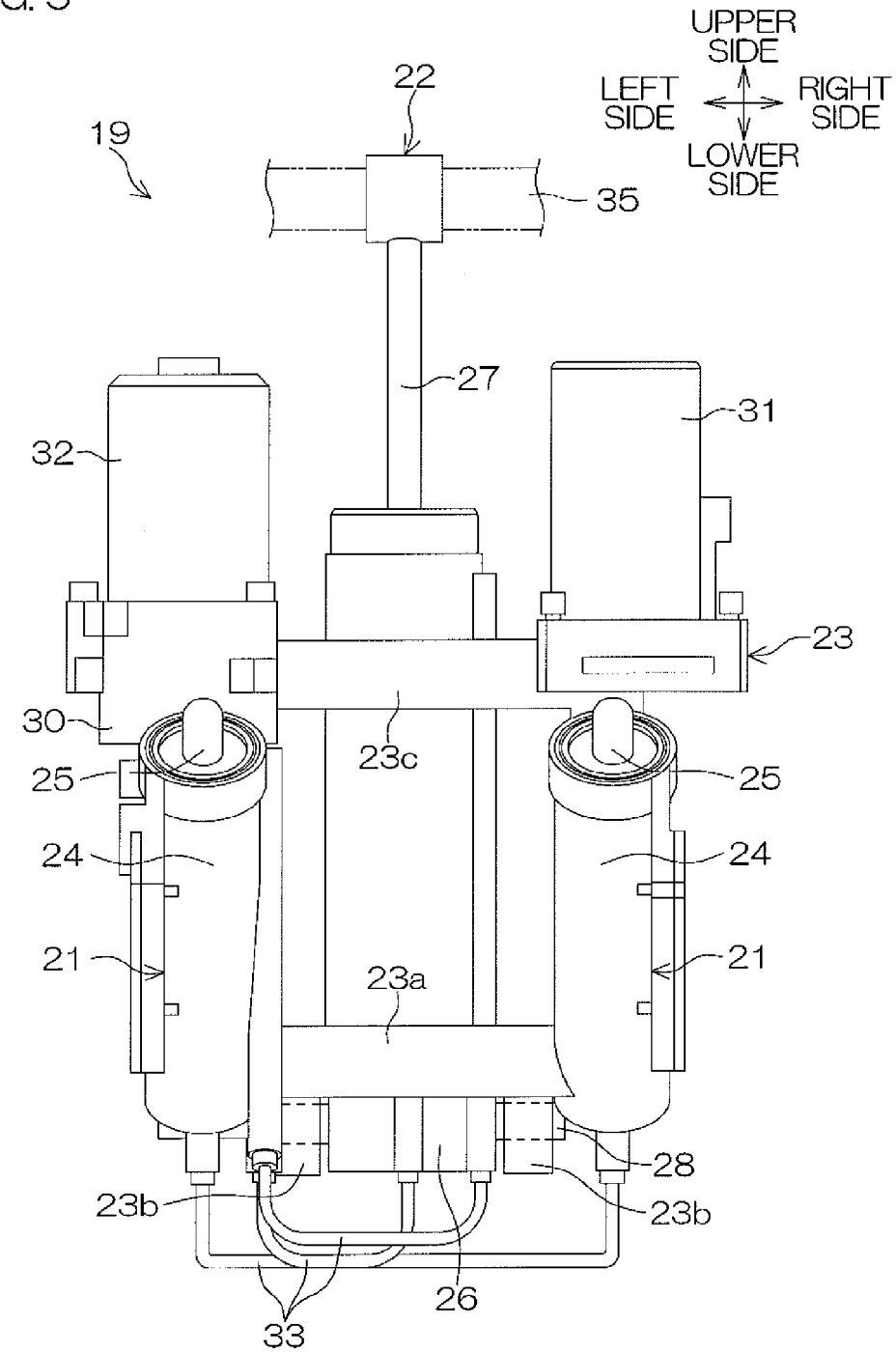
FIG. 5 is a back view of a tilt mechanism according to the first preferred embodiment of the present invention.

FIG. 5 is a back view of the tilt mechanism 19 according to the first preferred embodiment of the present invention. Hereinafter, the tilt mechanism 19 will be described with reference to FIG. 4B, FIG. 4C, and FIG. 5.

The tilt mechanism 19 includes two trim cylinders 21, a tilt cylinder 22, and a frame 23. The two trim cylinders 21 are disposed in parallel or substantially parallel to each other at an interval in the right-left direction, that is, a direction parallel or substantially parallel to the tilt axis L4. Each trim cylinder 21 is disposed obliquely along the front-rear direction so that the upper end of the trim cylinder 21 is positioned rearward relative to the lower end of the trim cylinder 21. The tilt cylinder 22 extends in the up-down direction. The upper end of the tilt cylinder 22 (upper end portion of a tilt rod 27) is positioned higher than the trim cylinders 21. The tilt cylinder 22 is disposed so that the tilt cylinder 22 is positioned between the two trim cylinders 21 as viewed in a front-rear direction, that is, a direction orthogonal or substantially orthogonal to the tilt axis L4.

Each trim cylinder 21 includes a cylinder main body 24 and a trim rod 25 extending along the central axis of the trim cylinder 21. Each trim rod 25 projects upward from the upper end of the cylinder main body 24. Each cylinder main body 24 is fixed to the frame 23. On the other hand, the tilt cylinder 22 includes a cylinder main body 26 and a tilt rod 27 extending along the central axis of the tilt cylinder 22. The tilt rod 27 projects upward from the upper end of the cylinder main body 26. The lower end portion of the cylinder main body 26 is joined to the frame 23 via a lower pin 28 extending in the right-left direction. The tilt cylinder 22 is joined to the frame 23 and the trim cylinders 21 via the lower pin 28. The tilt cylinder 22 is turnable around the lower pin 28 with respect to the frame 23 and the trim cylinders 21.

The cylinders 21 and 22 preferably are, for example, hydraulic cylinders. The tilt mechanism 19 includes a pump 30 that supplies hydraulic oil, a tank 31 storing the hydraulic oil, an electric motor 32 that drives the pump 30, and a plurality of pipes 33 connected to the pump 30 and the tank 31. The pump 30, the tank 31, the electric motor 32, and the pipes 33 are held by the frame 23. The pump 30 and the tank 31 are disposed at an interval in the right-left direction. The electric motor 32 is disposed above the pump 30. The pump 30 and the electric motor 32 are disposed above one trim cylinder 21, and the tank 31 is disposed above the other trim cylinder 21. The tilt cylinder 22 is disposed so that the tilt cylinder 22 is positioned between the pump 30 and electric motor 32 and the tank 31 as viewed in the front-rear direction.

The frame 23 includes a seat portion 23*a* disposed along a horizontal plane, a pair of projections 23*b* projecting downward from the seat portion 23*a*, and a support portion 23*c* disposed along a horizontal plane above the seat portion 23*a*. The pair of projections 23*b* are disposed at an interval in the right-left direction below the seat portion 23*a*. The cylinder main body 24 of the trim cylinder 21 is fixed to the frame 23. In the first preferred embodiment, for example, the cylinder main body 24 of the trim cylinder 21 and the frame 23 preferably are an integral casting. The cylinder main body 26 of the tilt cylinder 22 is inserted in a through-hole 23*d* (refer to FIG. 6) penetrating through the seat portion 23*a* in the up-down direction. The lower end portion of the cylinder main body 26 of the tilt cylinder 22 is disposed between the pair of projections 23*b*. The lower end portion of the cylinder main body 26 of the tilt cylinder 22 is joined to the pair of projections 23*b* via the lower pin 28. The pump 30, the tank 31, and the electric motor 32 are supported by the support portion 23*c*.

The pump 30, the tank 31, and the electric motor 32 are disposed rearward relative to the tilt cylinder 22. The lateral side of the pump 30, the tank 31, and the electric motor 32 is opened (for example, refer to FIG. 1). Therefore, the pump 30, the tank 31, and the electric motor 32 are exposed. The pipes 33 project downward from the frame 23. The pipes 33 are exposed from the frame 23. The cylinder main bodies 24 and 26 are connected to the pump 30 and the tank 31 via the plurality of pipes 33. The pipes 33 lead the hydraulic oil to the cylinders 21 and 22 and the tank 31. When the pump 30 is driven by the electric motor 32, the hydraulic oil is supplied to the cylinders 21 and 22 from the pump 30. When the hydraulic oil is supplied to the cylinder main bodies 24 of the trim cylinders 21 from the pump 30, the projecting amounts of the trim rods 25 change. Similarly, when the hydraulic oil is supplied from the pump 30 to the cylinder main body 26 of the tilt cylinder 22, the projecting amount of the tilt rod 27 changes.

Figure 6:
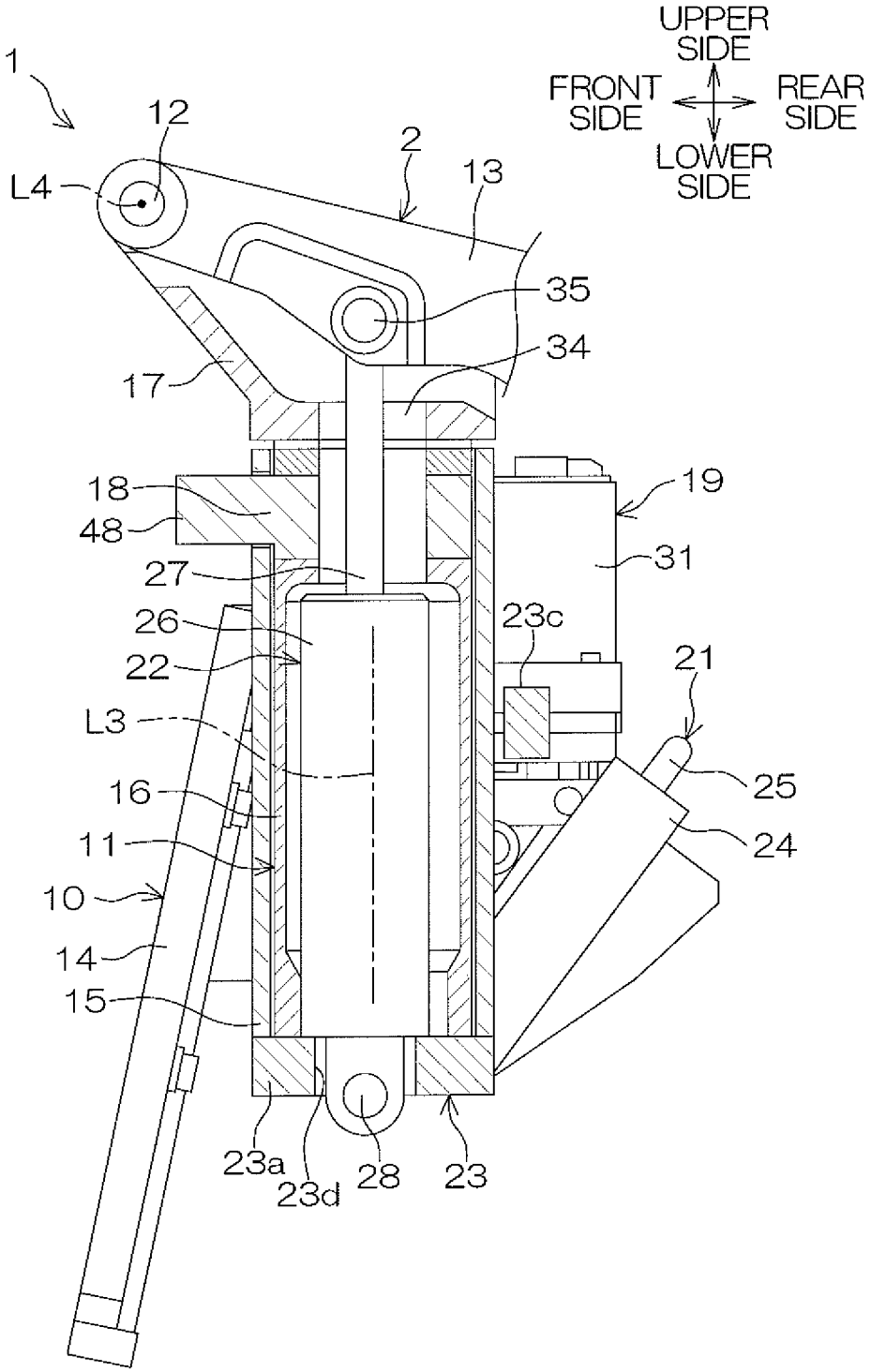
FIG. 6 is a partial sectional view of a portion of the first marine vessel propulsion apparatus including the tilt mechanism according to the first preferred embodiment of the present invention.
Figure 7:
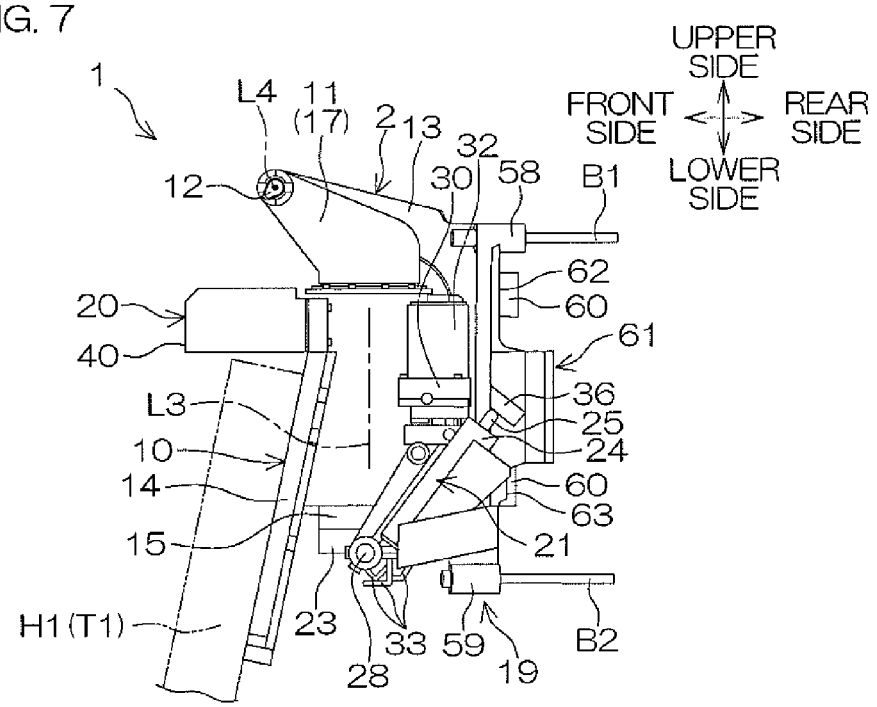
FIG. 7 is a side view of a portion of the first marine vessel propulsion apparatus including the tilt mechanism according to the first preferred embodiment of the present invention.
Figure 8:
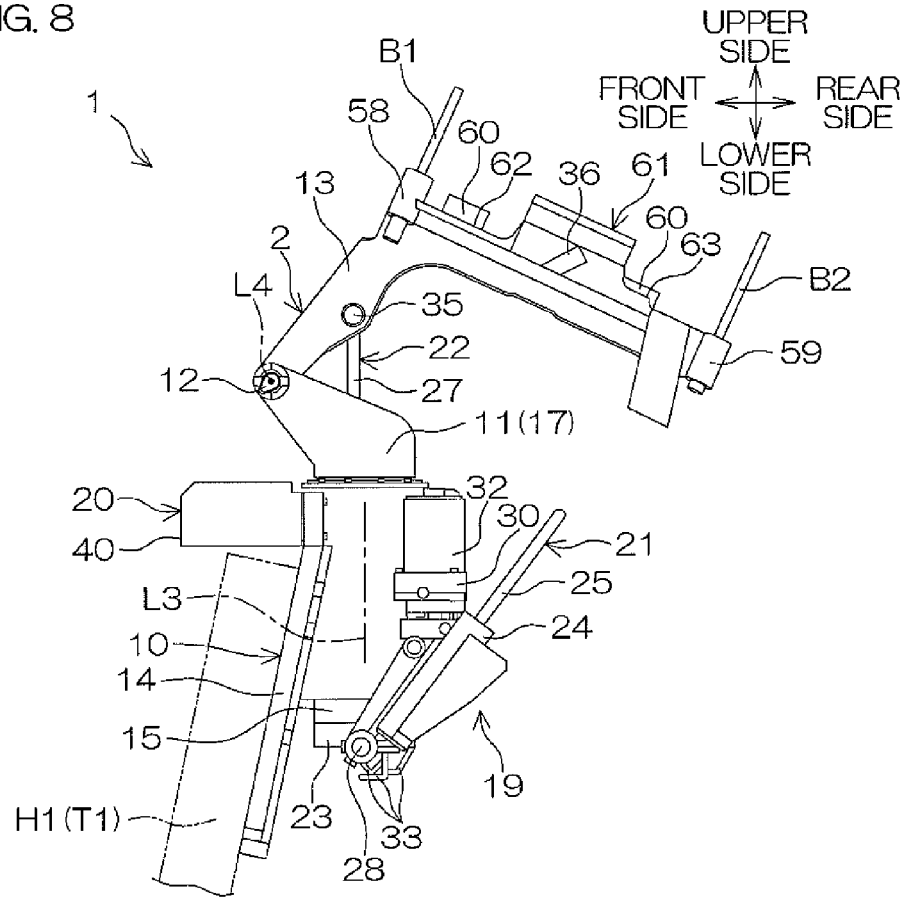
FIG. 8 is a side view of a portion of the first marine vessel propulsion apparatus including the tilt mechanism according to the first preferred embodiment of the present invention.

FIG. 6 is a partial sectional view of a portion of the first marine vessel propulsion apparatus 1 including the tilt mechanism 19 according to the first preferred embodiment of the present invention. FIG. 7 and FIG. 8 are side views of a portion of the first marine vessel propulsion apparatus 1 including the tilt mechanism 19 according to the first preferred embodiment of the present invention. FIG. 7 shows a position of the tilt bracket 13 when the outboard motor 2 is in a reference posture, and FIG. 8 shows a position of the tilt bracket 13 when the outboard motor 2 is fully tilted up (when the tilting angle of the outboard motor 2 is a full tilt-up angle).

As shown in FIG. 6, the intermediate portion 18 of the steering shaft 11 is tubular. The joint portion 17 of the steering shaft 11 has a through-hole 34 penetrating through the joint portion 17 in the up-down direction. The inside of the tubular portion 16 of the steering shaft 11 is connected to the through-hole 34 of the joint portion 17 via the inside of the intermediate portion 18. The tilt cylinder 22 is inserted in the steering shaft 11. The cylinder main body 26 is disposed inside the tubular portion 16. The lower end portion of the tubular portion 16 is joined to the frame 23. The frame 23 turns around the steering axis L3 together with the steering shaft 11. As described above, the cylinders 21 and 22, the pump 30, the tank 31, the electric motor 32, and the pipes 33 are held by the frame 23. Therefore, the cylinders 21 and 22, the pump 30, the tank 31, the electric motor 32, and the pipes 33 turn around the steering axis L3 together with the steering shaft 11.

The upper end portion of the tilt rod 27 projects upward from the through-hole 34 of the joint portion 17. The upper end portion of the tilt rod 27 is joined to the tilt bracket 13 via an upper pin 35 extending in the right-left direction. Therefore, the outboard motor 2 is supported by the tilt cylinder 22. The tilt rod 27 is turnable around the upper pin 35 with respect to the tilt bracket 13. On the other hand, as shown in FIG. 7, in a state in which the outboard motor 2 is positioned in the trim range, the tip ends of the trim rods 25 are in contact with contact portions 36 provided on the tilt bracket 13. Therefore, in the state in which the outboard motor 2 is positioned in the trim range, the outboard motor 2 is supported by the tilt cylinder 22 and the two trim cylinders 21. The contact portions 36 project laterally.

When the projecting amount of the tilt rod 27 increases, the tilt bracket 13 is pushed up by the tilt rod 27 and the outboard motor 2 turns up around the tilt axis L4. When the projecting amounts of the trim rods 25 increase in the state in which the outboard motor 2 is positioned in the trim range, the tilt bracket 13 is pushed up by the trim rods 25 and the outboard motor 2 turns up around the tilt axis L4. The tilt cylinder 22 can hold the outboard motor 2 at an arbitrary position between a full trim-in angle (see the outboard motor 2 shown by the alternate long and short dashed lines in FIG. 2) and a full tilt-up angle (see the outboard motor 2 shown by the solid line in FIG. 2). On the other hand, the trim cylinders 21 can hold the outboard motor 2 at an arbitrary position between the full trim-in angle and a full trim-out angle (see the outboard motor 2 shown by the alternate long and two short dashed lines in FIG. 2). Specifically, as shown in FIG. 8, when the tilting angle of the outboard motor 2 becomes larger than the full trim-out angle, the tip ends of the trim rods 25 separate from the contact portions 36 of the tilt bracket 13. Therefore, in the tilt range, the outboard motor 2 is supported by the tilt cylinder 22.

Figure 9:
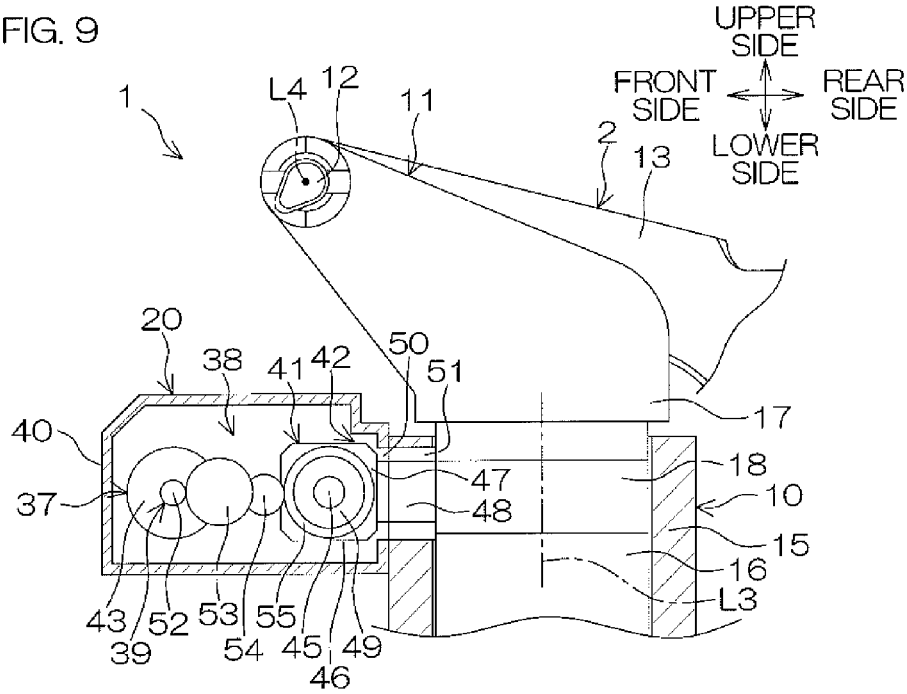
FIG. 9 is a partial sectional view of a portion of the first marine vessel propulsion apparatus including a steering mechanism according to the first preferred embodiment of the present invention.
Figure 10:
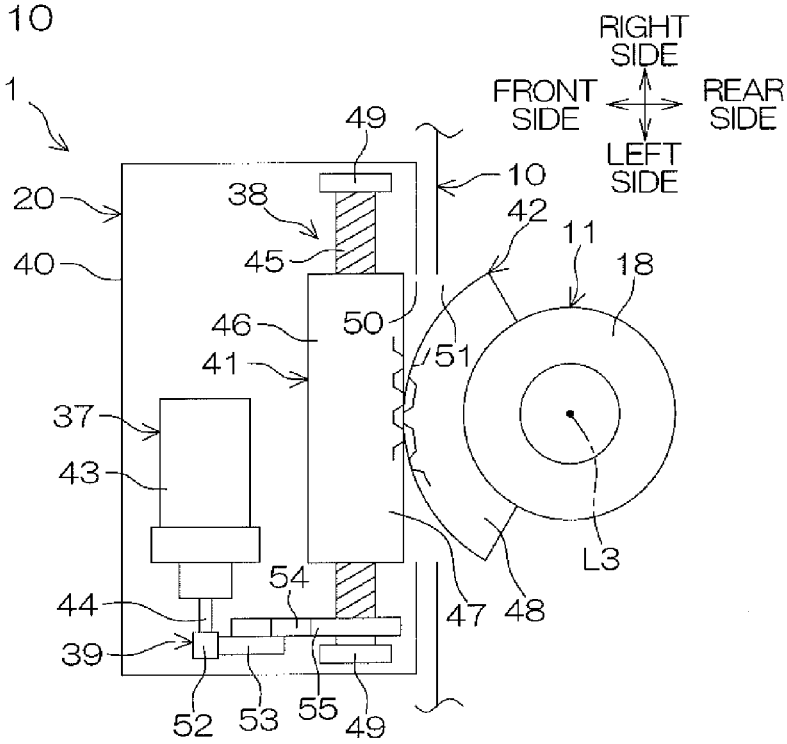
FIG. 10 is a schematic plan view of a portion of the first marine vessel propulsion apparatus including the steering mechanism according to the first preferred embodiment of the present invention.
Figure 11:
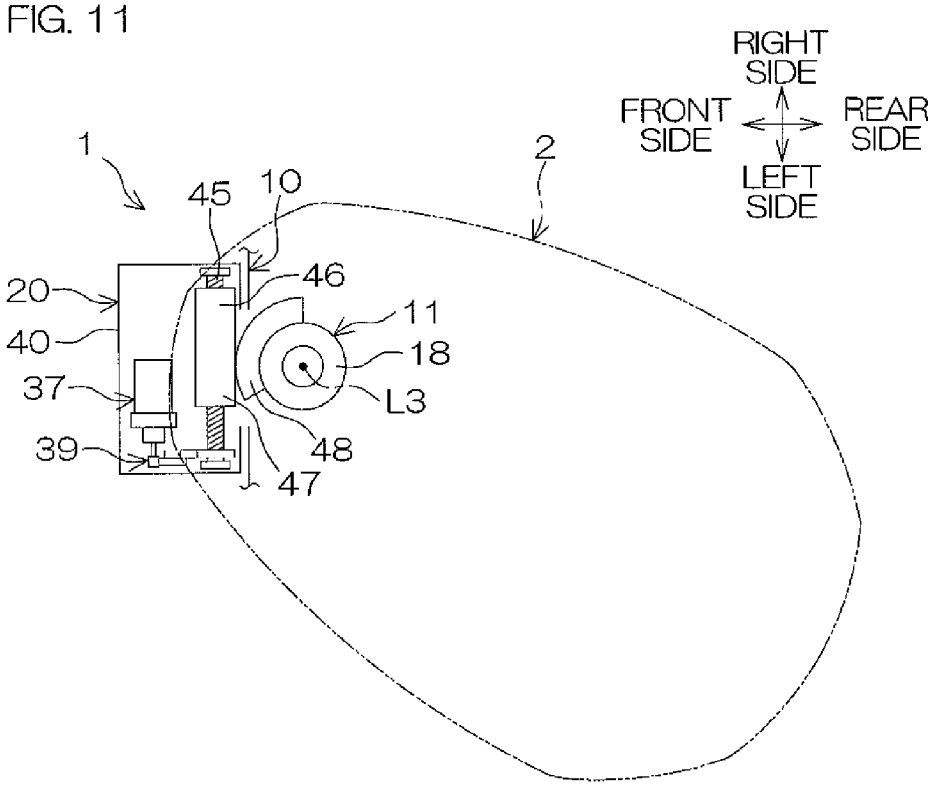
FIG. 11 is a schematic plan view of a portion of the first marine vessel propulsion apparatus including the steering mechanism according to the first preferred embodiment of the present invention.

FIG. 9 is a partial sectional view of a portion of the first marine vessel propulsion apparatus 1 including a steering mechanism 20 according to the first preferred embodiment of the present invention. FIG. 10 and FIG. 11 are schematic plan views of a portion of the first marine vessel propulsion apparatus 1 including the steering mechanism 20 according to the first preferred embodiment of the present invention.

The steering mechanism 20 includes an electric motor 37, a power conversion mechanism 38, a reduction gear mechanism 39, and a steering case 40. The reduction gear mechanism 39 decelerates the rotation of the electric motor 37 and transmits the decelerated rotation to the power conversion mechanism 38. The power conversion mechanism 38 converts the power of the electric motor 37 transmitted by the reduction gear mechanism 39 into turning of the steering shaft 11 around the steering axis L3. The outboard motor 2 and the tilt bracket 13 turn around the steering axis L3 with respect to the transom bracket 10 according to turning of the steering shaft 11 around the steering axis L3. The power conversion mechanism 38 includes a first conversion mechanism 41 that converts the rotation of the electric motor 37 into linear motion, and a second conversion mechanism 42 that converts the linear motion into turning of the steering shaft 11 around the steering axis L3 with respect to the transom bracket 10.

The electric motor 37 includes a motor main body 43 and a rotary shaft 44. The rotary shaft 44 is rotatable in the forward direction and the reverse direction opposite to the forward direction. The rotation of the rotary shaft 44 is transmitted to the first conversion mechanism 41 of the power conversion mechanism 38 via the reduction gear mechanism 39. The electric motor 37 is housed in a steering case 40. The electric motor 37 is disposed so that, for example, the rotary shaft 44 extends in the right-left direction. The motor main body 43 is fixed to the steering case 40. The steering case 40 is fixed to the transom bracket 10. Therefore, the electric motor 37 is fixed to the transom bracket 10 via the steering case 40. The electric motor 37 may be fixed to the transom bracket 10 via an intermediate member such as the steering case 40, or may be directly fixed to the transom bracket 10.

The first conversion mechanism 41 includes a first ball screw 45, and a tubular first ball nut 46 attached to the first ball screw 45 via a plurality of balls. The second conversion mechanism 42 includes a first rack 47 joined to the first ball nut 46, and a first pinion 48 engaged with the first rack 47. The first ball screw 45, the first ball nut 46, and the first rack 47 are housed in the steering case 40, and are held by the steering case 40. On the other hand, most of the first pinion 48 is disposed outside the steering case 40. The first pinion 48 is joined to the intermediate portion 18. Therefore, the first pinion 48 is joined to the tubular portion 16 and the joint portion 17 via the intermediate portion 18. The first pinion 48 turns around the steering axis L3 together with the steering shaft 11.

The first ball screw 45 extends in the right-left direction inside the steering case 40. The rotational axis of the first ball screw 45 and the rotational axis of the electric motor 37 are parallel or substantially parallel to each other. The first ball screw 45 is disposed rearward relative to the electric motor 37. Both end portions of the first ball screw 45 are supported on the steering case 40 via bearings 49. The first ball screw 45 is joined to the transom bracket 10 via the steering case 40, and joined to the electric motor 37 via the reduction gear mechanism 39. The rotation of the electric motor 37 is transmitted to the first ball screw 45 via the reduction gear mechanism 39. Accordingly, the first ball screw 45 is driven to rotate by the electric motor 37. When the first ball screw 45 rotates around the central axis of the first ball screw 45, the first ball nut 46 moves along the first ball screw 45, and the rotation of the first ball screw 45 is converted into linear motion of the first ball nut 46 with respect to the first ball screw 45.

The first rack 47 is provided on the outer peripheral portion of the first ball nut 46. The first rack 47 is, for example, integral with the first ball nut 46. The first rack 47 and the first ball nut 46 may constitute an integral member, or may constitute a member including a plurality of divided bodies joined integrally. The first rack 47 includes a plurality of teeth aligned in the axial direction of the first ball screw 45. The first rack 47 is opposed to the steering opening 50 provided in the steering case 40. The inside of the steering case 40 is connected to the inside of the housing portion 15 via a transom opening 51 provided in the housing portion 15 of the transom bracket 10. When the first ball screw 45 rotates, the first rack 47 moves along the first ball screw 45 together with the first ball nut 46.

The first pinion 48 projects from the outer peripheral portion of the intermediate portion 18. The first pinion 48 has, for example, a fan shape having a central axis positioned on the steering axis L3. The first pinion 48 is, for example, integral with the intermediate portion 18. The first pinion 48 and the intermediate portion 18 may constitute an integral member, or may constitute a member including a plurality of divided bodies joined integrally. The first pinion 48 enters the inside of the steering case 40 through the steering opening 50 and the transom opening 51. When the first rack 47 moves in the axial direction of the first ball screw 45, the position of engagement between the first rack 47 and the first pinion 48 moves and the first pinion 48 turns around the steering axis L3. Accordingly, the linear motion of the first ball nut 46 is converted into turning of the steering shaft 11 around the steering axis L3.

The reduction gear mechanism 39 includes a plurality of reduction gears (a first reduction gear 52, a second reduction gear 53, a third reduction gear 54, and a fourth reduction gear 55). The reduction gears 52 to 55 are, for example, external gears. The first reduction gear 52 is joined to the rotary shaft 44 of the electric motor 37. The first reduction gear 52 and the rotary shaft 44 are disposed coaxially with each other. The first reduction gear 52 rotates together with the rotary shaft 44. The first reduction gear 52 engages with the second reduction gear 53, and the second reduction gear 53 engages with the third reduction gear 54. The third reduction gear 54 engages with the fourth reduction gear 55. The second reduction gear 53 and the third reduction gear 54 are held rotatably by the steering case 40. The fourth reduction gear 55 is joined to the first ball screw 45. The fourth reduction gear 55 and the first ball screw 45 are disposed coaxially with each other. The first ball screw 45 rotates together with the fourth reduction gear 55.

The rotation of the electric motor 37 is transmitted to the first ball screw 45 by the reduction gear mechanism 39. The power of the electric motor 37 is amplified by deceleration of the rotation of the electric motor 37 by the reduction gear mechanism 39. The rotation of the first ball screw 45 is converted into linear motion of the first ball nut 46 with respect to the first ball screw 45 by the first ball screw 45 and the first ball nut 46. Then, the linear motion of the first ball nut 46 is converted into turning of the steering shaft 11 around the steering axis L3 by the first rack 47 and the first pinion 48. Accordingly, as shown in FIG. 11, the outboard motor 2 turns around the steering axis L3 with respect to the transom bracket 10. When the rotary shaft 44 of the electric motor 37 is driven to rotate in the forward direction, the outboard motor 2 turns in one rotating direction around the steering axis L3, and when the rotary shaft 44 of the electric motor 37 is driven to rotate in the reverse direction, the outboard motor 2 turns in the other rotating direction around the steering axis L3.

As described above, the electric motor 37 is fixed to the transom bracket 10 via the steering case 40. Therefore, when the outboard motor 2 turns around the steering axis L3 with respect to the transom bracket 10, the electric motor 37 does not turn around the steering axis L3 with respect to the transom bracket 10 together with the outboard motor 2 (refer to FIG. 11). Specifically, when the outboard motor 2 turns around the steering axis L3 with respect to the transom bracket 10, the position of the electric motor 37 with respect to the outboard motor 2 changes. On the other hand, the electric motor 37 is fixed to the transom bracket 10, so that when the outboard motor 2 turns around the tilt axis L4 with respect to the transom bracket 10, the electric motor 37 does not turn around the tilt axis L4 with respect to the transom bracket 10 together with the outboard motor 2 (refer to FIG. 2). Specifically, when the outboard motor 2 turns around the tilt axis L4 with respect to the transom bracket 10, the position of the electric motor 37 with respect to the outboard motor 2 changes.

Figure 12:
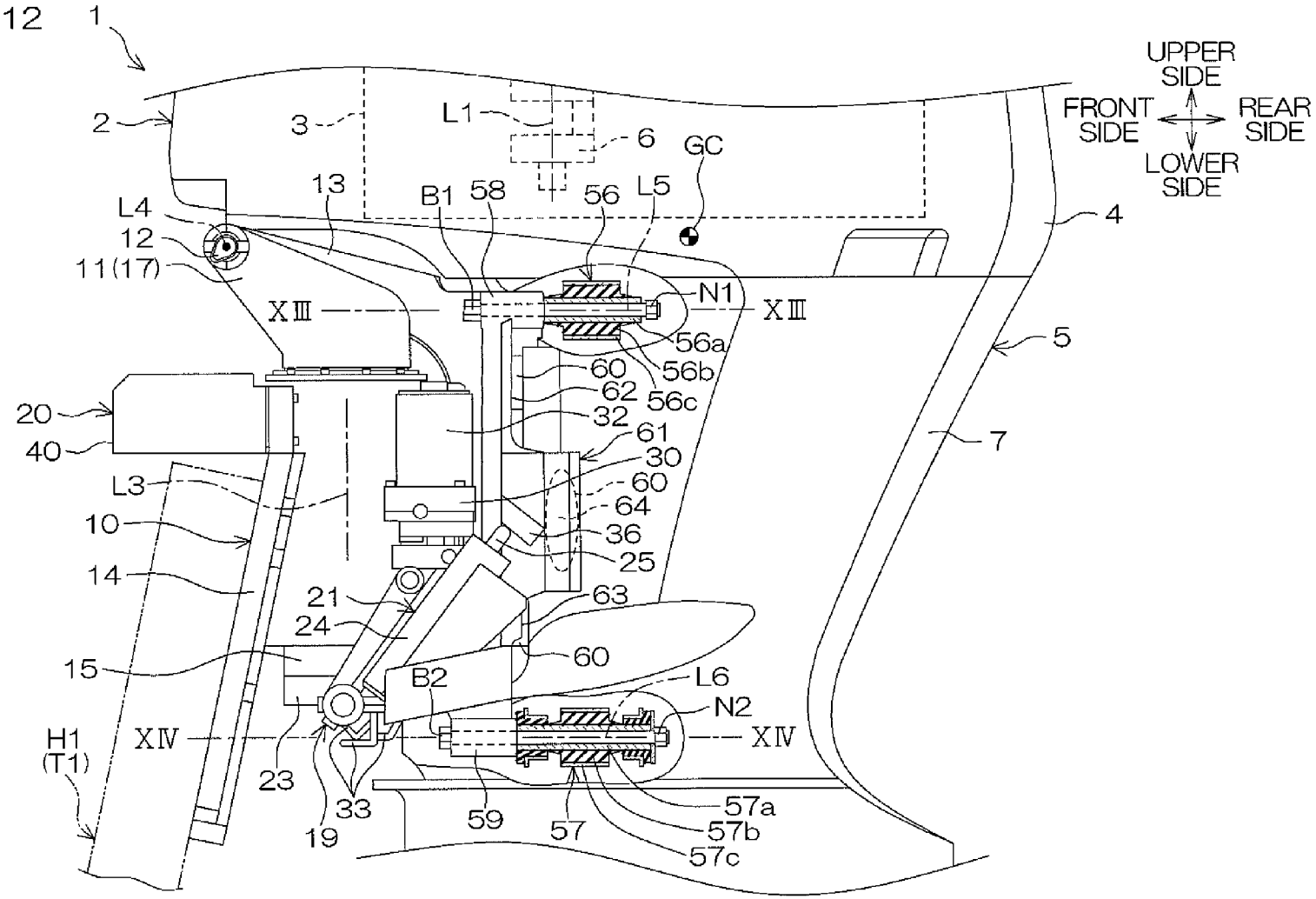
FIG. 12 is an enlarged partial sectional view of a portion of the first marine vessel propulsion apparatus according to the first preferred embodiment of the present invention.
Figure 13:
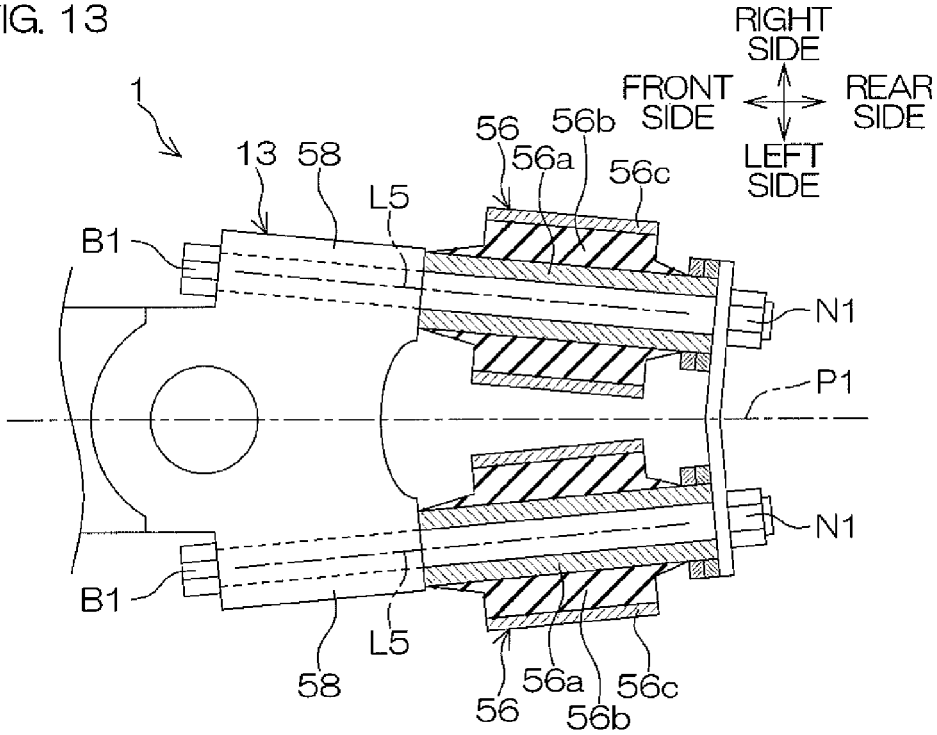
FIG. 13 is a sectional view of the first marine vessel propulsion apparatus taken along line XIII-XIII in FIG. 12.
Figure 14:
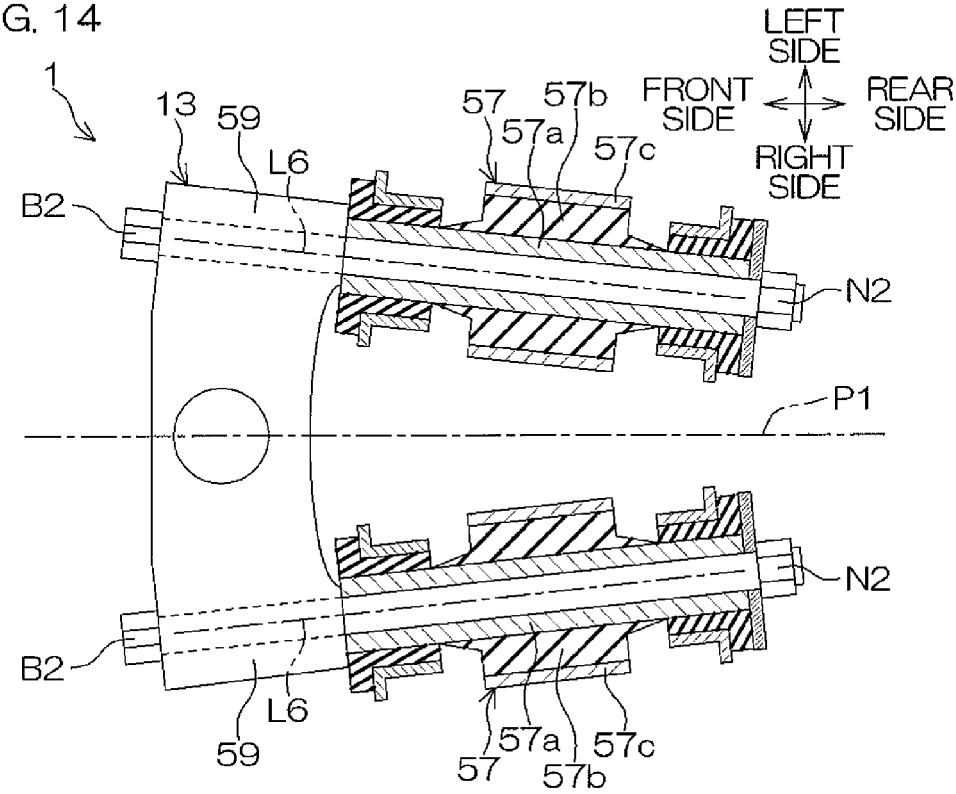
FIG. 14 is a sectional view of the first marine vessel propulsion apparatus taken along line XIV-XIV in FIG. 12.

FIG. 12 is an enlarged partial sectional view of a portion of a first marine vessel propulsion apparatus 1 according to a first preferred embodiment of the present invention. FIG. 13 is a sectional view of the first marine vessel propulsion apparatus 1 taken along line XIII-XIII in FIG. 12. FIG. 14 is a sectional view of the first marine vessel propulsion apparatus 1 taken along line XIV-XIV in FIG. 12. FIG. 14 shows a state in which the tilt bracket 13 and an arrangement relating thereto are viewed from below.

The first marine vessel propulsion apparatus 1 includes two upper mounts 56 and two lower mounts 57. The upper mounts 56 are an example of a first mount according to the first preferred embodiment of the present invention, and the lower mounts 57 are an example of a second mount according to the first preferred embodiment of the present invention. The upper mounts 56 and the lower mounts 57 are disposed inside the outboard motor 2, and held by the outboard motor 2. The two upper mounts 56 are disposed at the same height at an interval in the right-left direction. Similarly, the two lower mounts 57 are disposed at the same height at an interval in the right-left direction. The lower mounts 57 are disposed lower than the upper mounts 56. The tilt bracket 13 is joined to the outboard motor 2 via the upper mounts 56 and the lower mounts 57.

The upper mounts 56 are tubular and have elasticity. The two upper mounts 56 are disposed symmetrically about a plane P1 (hereinafter, referred to as "reference plane P1", simply) including the steering axis L3 and orthogonal or substantially orthogonal to the tilt axis L4. The upper mounts 56 are disposed so that the central axes L5 of the upper mounts 56 extend horizontally. Further, the two upper mounts 56 are disposed along directions inclined with respect to the front-rear direction so that the interval between the central axes L5 of the two upper mounts 56 becomes smaller toward the rear side. Each upper mount 56 includes an inner tube 56*a*, an outer tube 56*c*, and a tubular elastic member 56*b*. The elastic member 56*b* surrounds the inner tube 56*a* around the central axis L5 of the upper mount 56, and the outer tube 56*c* surrounds the elastic member 56*b* around the central axis L5 of the upper mount 56. The elastic member 56*b* is coupled to the outer peripheral surface of the inner tube 56*a* and the inner peripheral surface of the outer tube 56*c*. The upper mounts 56 are held on the outboard motor 2 by fixation of the outer tubes 56*c* to the outboard motor 2.

The lower mounts 57 are tubular and have elasticity. The two lower mounts 57 are disposed symmetrically about the reference plane P1. The lower mounts 57 are disposed so that the central axes L6 of the lower mounts 57 extend horizontally. Further, the two lower mounts 57 are disposed along directions inclined with respect to the front-rear direction so that the interval between the central axes L6 of the two lower mounts 57 become smaller toward the rear side. Each lower mount 57 includes an inner tube 57*a*, an outer tube 57*c*, and a tubular elastic member 57*b*. The elastic member 57*b* surrounds the inner tube 57*a* around the central axis L6 of the lower mount 57, and the outer tube 57*c* surrounds the elastic member 57*b* around the central axis L6 of the lower mount 57. The elastic member 57*b* is coupled to the outer peripheral surface of the inner tube 57*a* and the inner peripheral surface of the outer tube 57*c*. The lower mounts 57 are held on the outboard motor 2 by fixation of the outer tubes 57*c* to the outboard motor 2.

The tilt bracket 13 includes two first joint portions 58 and two second joint portions 59. The two first joint portions 58 are disposed at the same height at an interval in the right-left direction. Similarly, the two second joint portions 59 are disposed at the same height at an interval in the right-left direction. The second joint portions 59 are disposed lower than the first joint portions 58. The two first joint portions 58 are joined to the two upper mounts 56, respectively. The two second joint portions 59 are joined to the two lower mounts 57, respectively. Therefore, the first joint portions 58 are joined to the outboard motor 2 via the upper mounts 56, and the second joint portions 59 are joined to the outboard motor 2 via the lower mounts 57.

The first joint portions 58 are tubular. The insides of the first joint portions 58 are connected to the insides of the inner tubes 56*a* of the upper mounts 56. The first marine vessel propulsion apparatus 1 includes first bolts B1 and first nuts N1 that join the first joint portions 58 and the upper mounts 56. The first bolts B1 are inserted into the first joint portions 58 and the inner tubes 56*a* from the front side. The end portions of the first bolts B1 project rearward from the inner tubes 56*a*. The first nuts N1 are attached to the end portions of the first bolts B1. The inner tubes 56*a* are sandwiched between the first joint portions 58 and the first nuts N1. Accordingly, the first joint portions 58 are joined to the inner tubes 56*a* of the upper mounts 56.

Similarly, the second joint portions 59 are tubular. The insides of the second joint portions 59 are connected to the insides of the inner tubes 57*a* of the lower mounts 57. The first marine vessel propulsion apparatus 1 includes second bolts B2 and second nuts N2 that join the second joint portions 59 and the lower mounts 57. The second bolts B2 are inserted into the second joint portions 59 and the inner tubes 57*a* from the front side. The end portions of the second bolts B2 project rearward from the inner tubes 57*a*. The second nuts N2 are attached to the end portions of the second bolts B2. The inner tubes 57*a* are sandwiched between the second joint portions 59 and the second nuts N2. Accordingly, the second joint portions 59 are joined to the inner tubes 57*a* of the lower mounts 57.

Figure 15:
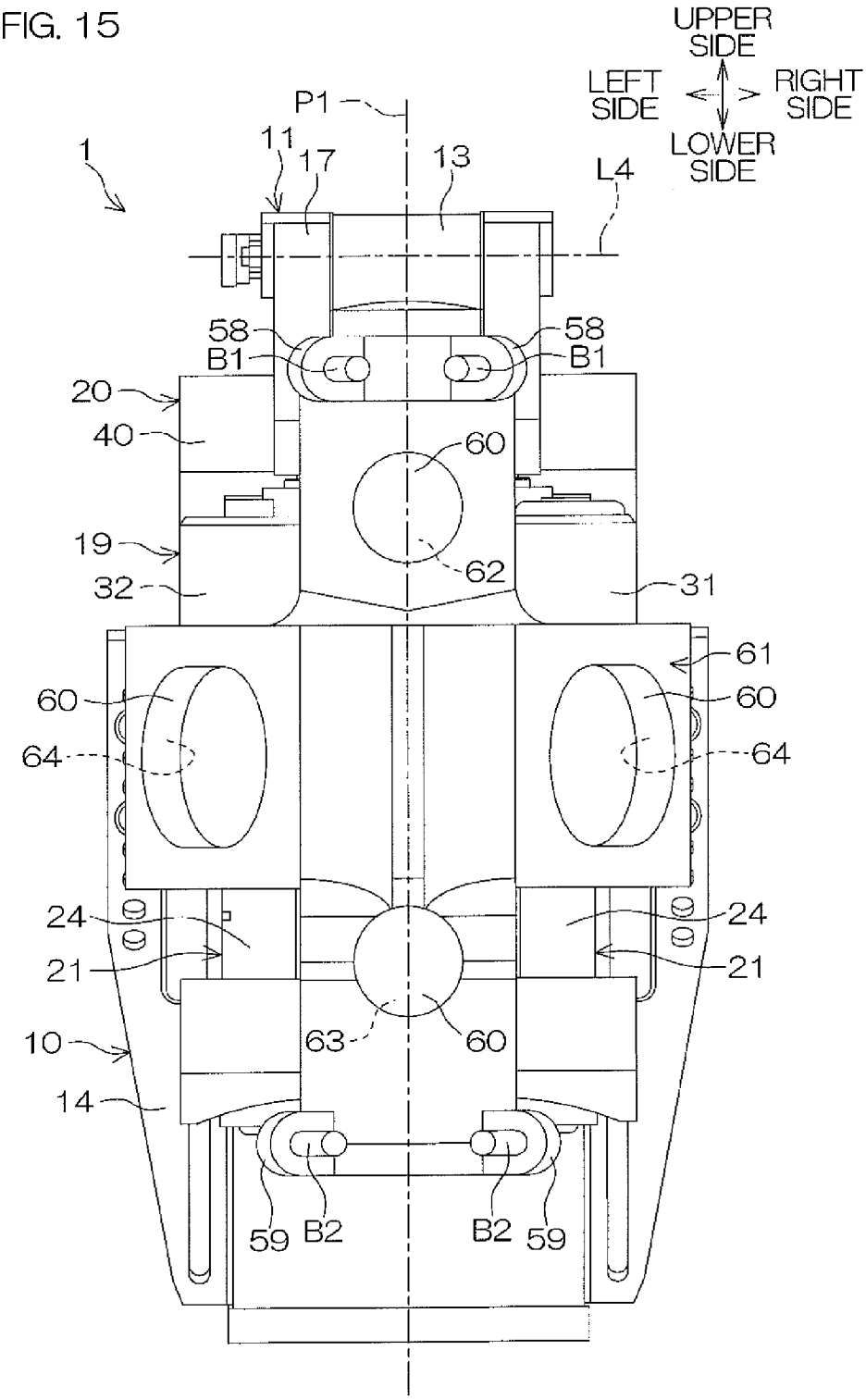
FIG. 15 is a back view of a tilt bracket and an arrangement relating thereto according to the first preferred embodiment of the present invention.
Figure 16:
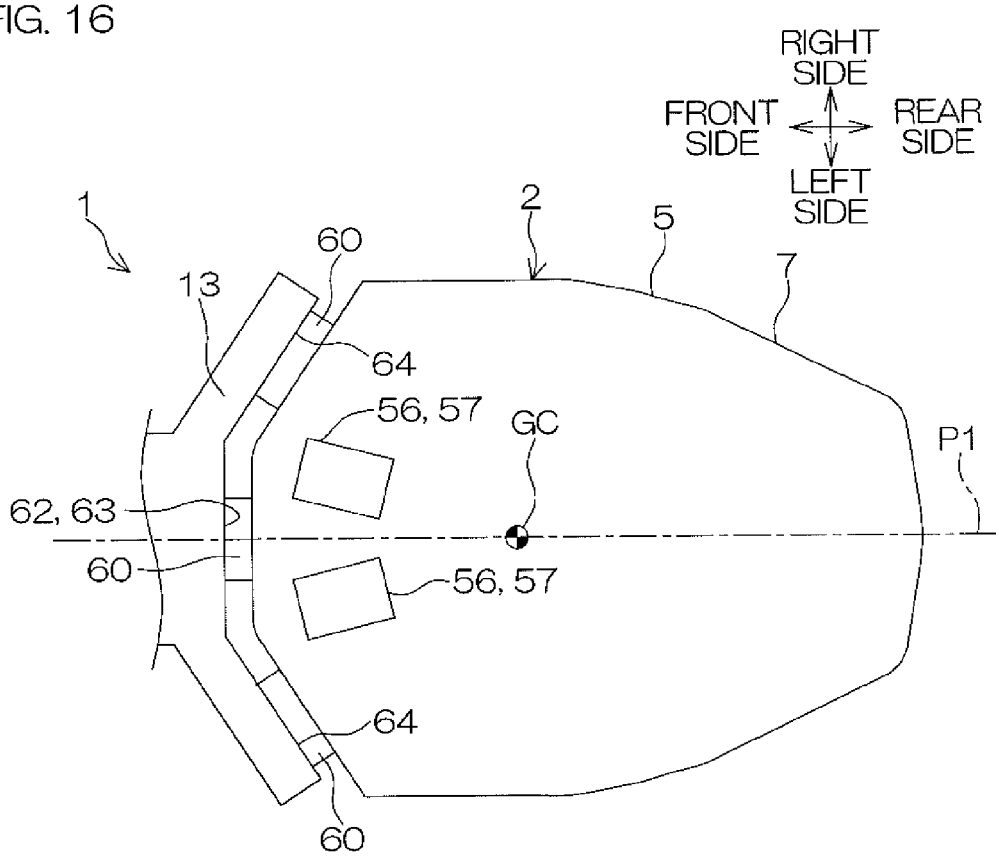
FIG. 16 is a schematic plan view for describing a supported state of an outboard motor according to the first preferred embodiment of the present invention.

FIG. 15 is a back view of the tilt bracket 13 and an arrangement relating thereto according to the first preferred embodiment of the present invention. FIG. 16 is a schematic plan view for describing a supported state of the outboard motor 2 according to the first preferred embodiment of the present invention. Hereinafter, the supported state of the outboard motor 2 will be described with reference to FIG. 12, FIG. 15, and FIG. 16.

The first marine vessel propulsion apparatus 1 includes a plurality of third mounts 60. The third mounts 60 are, for example, block-shaped elastic bodies. The third mounts 60 preferably include a synthetic rubber or synthetic resin. The third mounts 60 are held on, for example, the tilt bracket 13. The tilt bracket 13 includes a support portion 61 that supports the outboard motor 2 via the plurality of third mounts 60. The support portion 61 is disposed at a height between the first joint portions 58 and the second joint portions 59. The support portion 61 is symmetrical about the reference plane P1. The support portion 61 includes an upper support portion 62 and a lower support portion 63 disposed at an interval in the up-down direction, and two lateral support portions 64 disposed at an interval in the right-left direction with respect to the upper support portion 62 and the lower support portion 63.

The upper support portion 62 and the lower support portion 63 are disposed at an interval in the up-down direction at a central portion of the tilt bracket 13 in the right-left direction. The upper support portion 62 is disposed higher than the lower support portion 63. The upper support portion 62 is symmetrical about the reference plane P1, and the lower support portion 63 is symmetrical with respect to the reference plane P1. The upper support portion 62 is disposed higher than the lateral support portions 64, and the lower support portion 63 is disposed lower than the lateral support portions 64. The upper support portion 62 and the lower support portion 63 hold the third mounts 60. The upper support portion 62 and the lower support portion 63 support a casing 5 in the front-rear direction via the third mounts 60.

On the other hand, the lateral support portions 64 extend in the right-left direction along the casing 5. One lateral support portion 64 is disposed rightward relative to the upper support portion 62 and the lower support portion 63, and the other lateral support portion 64 is disposed leftward relative to the upper support portion 62 and the lower support portion 63. The two lateral support portions 64 are disposed at the same height at an interval in the right-left direction around the reference plane P1. Therefore, the two lateral support portions 64 are symmetrical about the reference plane P1. Each lateral support portion 64 supports the third mount 60. Each lateral support portion 64 supports the casing 5 in a direction inclined with respect to the front-rear direction via the third mount 60. The two lateral support portions 64 support the casing 5 at positions separate from each other in the right-left direction with respect to the upper mounts 56 and the lower mounts 57. The two lateral support portions 64 support the casing 5 on the side forward relative to the gravity center GC of the outboard motor 2.

The tilt bracket 13 turns together with the outboard motor 2 when the outboard motor 2 turns around either of the steering axis L3 and the tilt axis L4. Therefore, when the outboard motor 2 turns around either of the steering axis L3 and the tilt axis L4, the state in which the outboard motor 2 is supported by the support portion 61 via the third mounts 60 is maintained. A propulsive force generated by the outboard motor 2 is transmitted to the two first joint portions 58 and the two second joint portions 59 via the two upper mounts 56 and the two lower mounts 57. Further, the propulsive force generated by the outboard motor 2 is transmitted to the support portion 61 via the plurality of third mounts 60. Accordingly, the propulsive force is transmitted to the hull H1 via the tilt bracket 13, and the hull H1 is propelled.

Vibration of the engine 3 caused by rotation of the crankshaft 6, reciprocating movement of the piston, and explosion in the engine 3 is blocked by the upper mounts 56, the lower mounts 57, and the third mounts 60. Similarly, vibration of the propeller 9 caused by torque fluctuation is blocked by the upper mounts 56, the lower mounts 57, and the third mounts 60. Specifically, vibration of the outboard motor 2 is blocked by the upper mounts 56, the lower mounts 57, and the third mounts 60. Accordingly, transmission of vibration of the outboard motor 2 to the hull H1 is minimized. Therefore, transmission of vibration of the outboard motor 2 to passengers is minimized.

As described above, in the first preferred embodiment, the outboard motor 2 is supported by the first joint portions 58, the second joint portions 59, and the support portion 61 provided on the tilt bracket 13. Specifically, the first joint portions 58 are joined to the outboard motor 2 via the upper mounts 56, and the second joint portions 59 are joined to the outboard motor 2 via the lower mounts 57. The support portion 61 supports the outboard motor 2 via the third mounts 60 at a height between the upper mounts 56 and the lower mounts 57. When the outboard motor 2 turns around either of the steering axis L3 and the tilt axis L4, the state in which the outboard motor 2 is supported by the first joint portions 58, the second joint portions 59, and the support portion 61 is maintained. Therefore, when the outboard motor 2 turns around either of the axes L3 and L4, vibration of the outboard motor 2 is blocked by the first joint portions 58, the second joint portion 59, and the support portion 61. Further, when the outboard motor 2 turns around either of the axes L3 and L4, the propulsive force generated by the outboard motor 2 is transmitted to the hull H1 via the first joint portions 58, the second joint portions 59, and the support portion 61.

In detail, vibration of the outboard motor 2 is blocked by the upper mounts 56 and the lower mounts 57, and the third mounts 60 that have elasticity. Accordingly, transmission of vibration of the outboard motor 2 to passengers can be minimized. The propulsive force generated by the outboard motor 2 is transmitted from the outboard motor 2 to the first joint portions 58 and the second joint portions 59 via the upper mounts 56 and the lower mounts 59. Further, the propulsive force generated by the outboard motor 2 is transmitted from the outboard motor 2 to the support portion 61 via the third mounts 60. Thus, as well as the upper mounts 56 and the lower mounts 57, the third mounts 60 also block vibration of the outboard motor 2, and third mounts 60 and the support portion 61 also transmit the propulsive force. Therefore, the degree of freedom of the design of the upper mounts 56 and the lower mounts 57 can be increased. The third mounts 60 are disposed between the outboard motor 2 and the tilt bracket 13, so that limitations on the size and number of third mounts 60 are less than those of the upper mounts 56 and the lower mounts 57 disposed inside the outboard motor 2. Therefore, by properly adjusting the numbers, elastic coefficients, contraction amounts, orientations, and positions, etc., of the mounts 56, 57, and 60, transmission of vibration of the outboard motor 2 to the hull H1 can be minimized, and the posture holding force of the outboard motor 2 can be increased.

If the elastic coefficients of the upper mounts 56 and the lower mounts 57 are small, vibration of the outboard motor 2 is hardly transmitted to the hull H1. However, if the elastic coefficients of the upper mounts 56 and the lower mounts 57 are small, the load that can be transmitted from the outboard motor 2 to the hull H1 is reduced. As described above, in the first preferred embodiment, the third mounts 60 are provided, so that even if the elastic coefficients of the upper mounts 56 and the lower mounts 57 are reduced, a load with the same magnitude as in the case where the third mounts 60 are not provided can be transmitted from the outboard motor 2 to the hull H1. Therefore, by using the upper mounts 56 and the lower mounts 57 with small elastic coefficients and the third mounts 60, while the posture holding force of the outboard motor 2 is maintained, transmission of vibration of the outboard motor 2 to the hull H1 can be minimized. Further, the third mounts 60 are provided, so that the propulsive force is further dispersed, and a load to be applied to the upper mounts 56 and the lower mounts 57 is reduced. Therefore, even when the marine vessel running at a high speed jumps and a high impact load is applied to the outboard motor 2, the high load can be prevented from being applied in a concentrated manner to the mounts 56, 57, and 60. Accordingly, the outboard motor 2 can be reliably supported.

In the first preferred embodiment, the support portion 61 includes two lateral support portions 64 that support the outboard motor 2 at positions separate from the upper mounts 56 and the lower mounts 57 in the right-left direction. Therefore, the outboard motor 2 is supported at a plurality of portions separate from each other in the right-left direction by the first joint portions 58, the second joint portions 59, and the support portion 61. Accordingly, the outboard motor 2 can be stabilized. The lateral support portions 64 support the outboard motor 2 in directions inclined with respect to the front-rear direction via the third mount 60. From the outboard motor 2 to the lateral support portions 64, a load is transmitted in the directions inclined with respect to the front-rear direction. Therefore, the directions of the propulsive force to be transmitted from the outboard motor 2 to the lateral support portions 64 are inclined with respect to the front-rear direction. On the other hand, the piston, etc., reciprocates in the front-rear direction, so that the engine 3 vibrates mainly in the front-rear direction. Specifically, the main direction of vibration of the outboard motor 2 is the front-rear direction. Thus, the transmission directions of the propulsive force to the lateral support portions 64 and the main direction of vibration are different from each other, so that generation of vibration (coupled vibration) including a combined vibration generated by transmission of the propulsive force and vibration of the outboard motor 2 is minimized.

Second Preferred Embodiment

Figure 17:
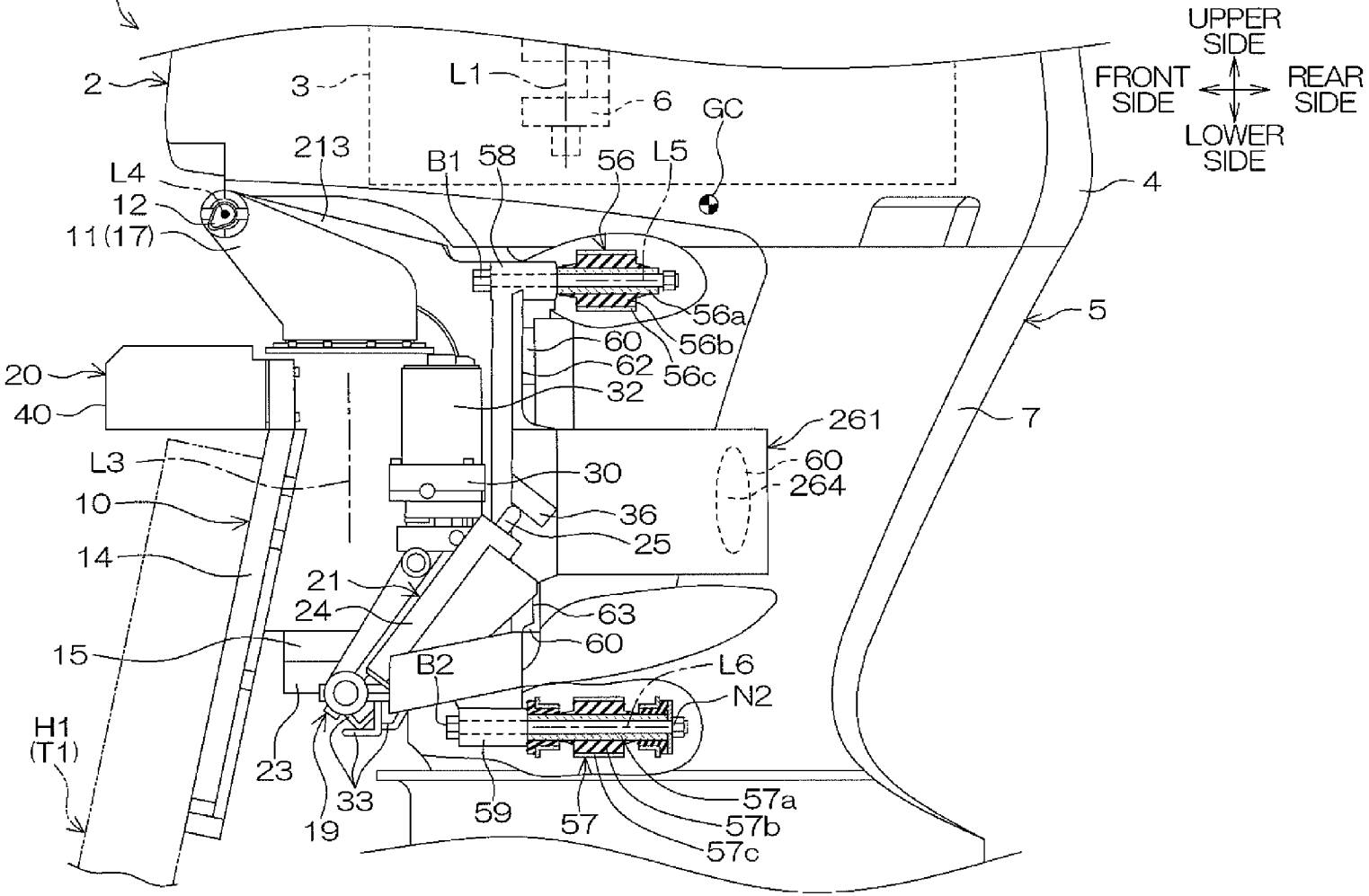
FIG. 17 is an enlarged partial sectional view of a portion of a first marine vessel propulsion apparatus according to a second preferred embodiment of the present invention.
Figure 18:
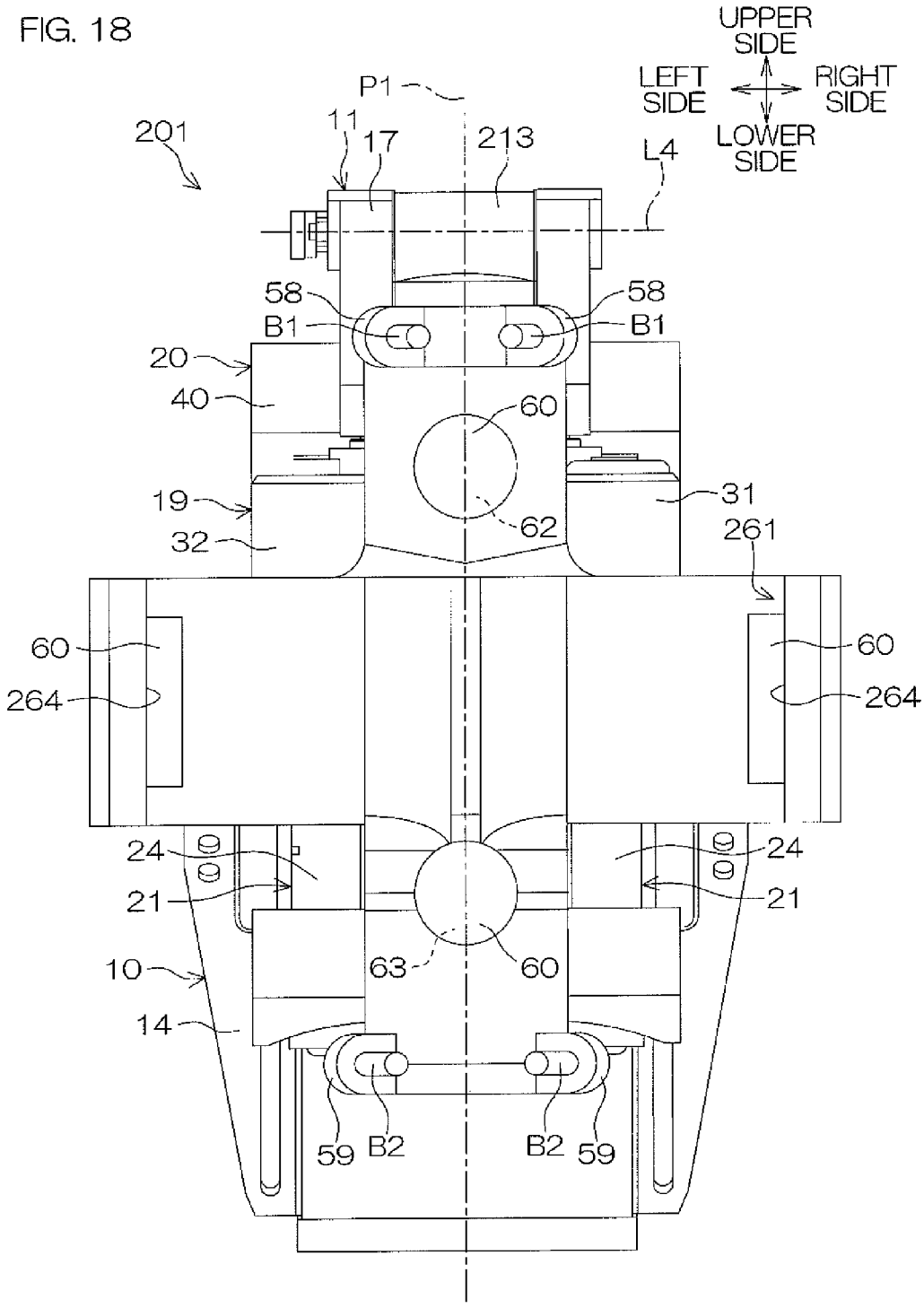
FIG. 18 is a back view of a tilt bracket and an arrangement relating thereto according to the second preferred embodiment of the present invention.
Figure 19:
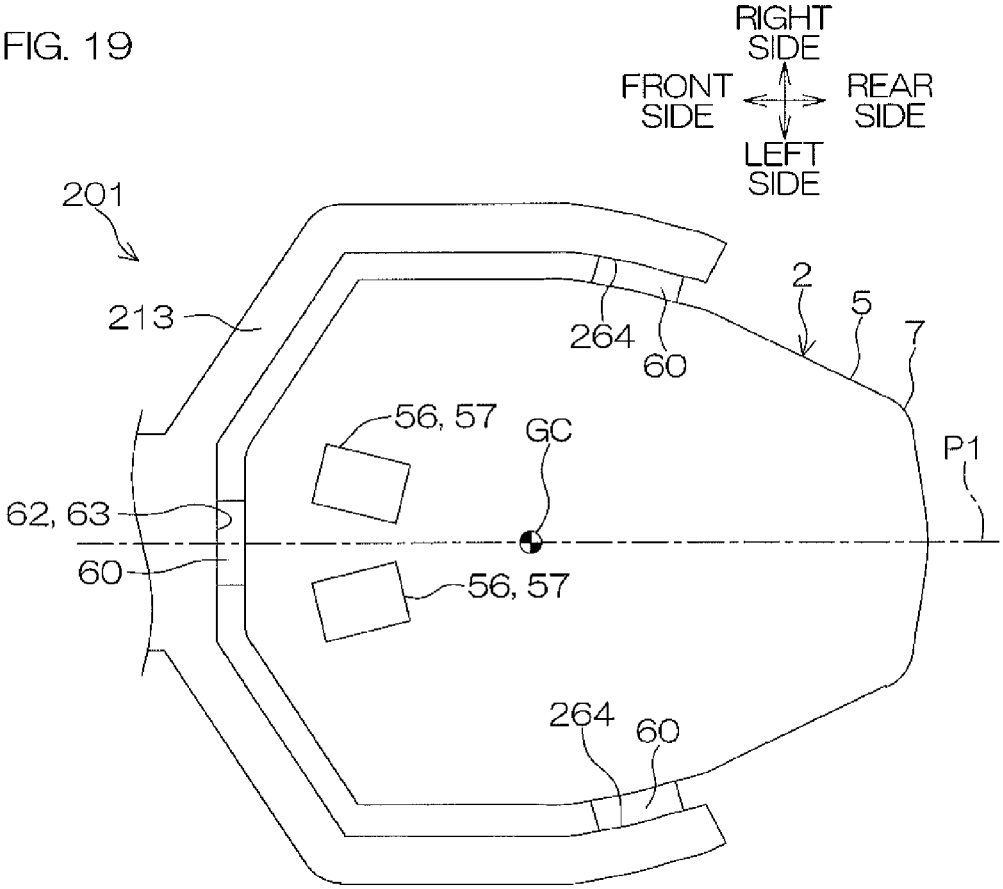
FIG. 19 is a schematic plan view for describing a supported state of an outboard motor according to the second preferred embodiment of the present invention.

FIG. 17 is an enlarged partial sectional view of a portion of a first marine vessel propulsion apparatus 201 according to a second preferred embodiment of the present invention. FIG. 18 is a back view of a tilt bracket 213 and an arrangement relating thereto according to the second preferred embodiment of the present invention. FIG. 19 is a schematic plan view for describing a supported state of an outboard motor 2 according to the second preferred embodiment of the present invention. In FIG. 17 to FIG. 19, constitutional portions equivalent to the portions shown in FIG. 1 to FIG. 16 described above are provided with the same reference numerals as in FIG. 1, etc., and descriptions thereof will be omitted.

A main difference between the second preferred embodiment and the first preferred embodiment described above is that the first marine vessel propulsion apparatus 201 includes a tilt bracket 213 instead of the tilt bracket 13 according to the first preferred embodiment. A support portion 261 provided on the tilt bracket 213 supports the outboard motor 2 on the side rearward relative to the crankshaft 6. The arrangement of the tilt bracket according to the first preferred embodiment and the arrangement of the tilt bracket according to the second preferred embodiment are the same except for the support portion, so that hereinafter, the support portion 261 will be described in detail.

The tilt bracket 213 includes the support portion 261 that supports the outboard motor 2 via a plurality of third mounts 60. The support portion 261 is disposed at a height between the first joint portions 58 and the second joint portions 59. The support portion 261 is symmetrical about the reference plane P1. The support portion 261 includes an upper support portion 62 and a lower support portion 63 disposed at an interval in the up-down direction, and two lateral support portions 264 disposed at an interval in the right-left direction with respect to the upper support portion 62 and the lower support portion 63. The upper support portion 62 and the lower support portion 63 are an example of a front support portion according to the second preferred embodiment of the present invention, and the lateral support portions 264 are an example of a rear support portion according to the second preferred embodiment of the present invention.

The lateral support portions 264 extend in the right-left direction along the casing 5. One lateral support portion 264 is disposed on the right side relative to the upper support portion 62 and the lower support portion 63, and the other lateral support portion 264 is disposed on the left side relative to the upper support portion 62 and the lower support portion 63. The two lateral support portions 264 are disposed at the same height at an interval in the right-left direction around the reference plane P1. Therefore, the two lateral support portions 264 are symmetrical about the reference plane P1. Each lateral support portion 264 holds the third mount 60. Each lateral support portion 264 supports the casing 5 in a direction inclined with respect to the front-rear direction via the third mount 60. The two lateral support portions 264 support the casing 5 at positions separate from the upper mounts 56 and the lower mounts 57 in the right-left direction.

The two lateral support portions 264 support the outboard motor 2 on the side rearward relative to the gravity center GC of the outboard motor 2. The crankshaft 6 is positioned forward relative to the gravity center GC of the outboard motor 2. Therefore, the two lateral support portions 264 support the outboard motor 2 on the side rearward relative to the crankshaft 6. The upper support portion 62 and the lower support portion 63 support the outboard motor 2 on the side forward relative to the gravity center GC of the outboard motor 2. Therefore, the upper support portion 62 and the lower support portion 63 support the outboard motor 2 on the side forward relative to the two lateral support portions 264. The casing 5 is supported so as to be sandwiched in the right-left direction by the two lateral support portions 264. The front portion (the portion positioned forward relative to the gravity center GC of the outboard motor 2) of the casing 5 is housed inside the tilt bracket 213 in a plan view.

As described above, in the second preferred embodiment, the support portion 261 provided on the tilt bracket 213 supports the outboard motor 2 at a plurality of points separate from each other in the front-rear direction by the upper support portion 62, the lower support portion 63, and the two lateral support portions 264. Accordingly, the outboard motor 2 can be stabilized. The tilt bracket 213 surrounds the gravity center GC of the outboard motor 2 in a plan view. The gravity center GC of the outboard motor 2 substantially matches the center of vibration of the outboard motor 2. By surrounding the center of vibration of the outboard motor 2 by the tilt bracket 213, the outboard motor 2 can be supported more stably. Accordingly, the natural frequency of the first marine vessel propulsion apparatus 201 can be moved to a range other than the regular range of vibration, that is, the range of frequency of vibration during use of the outboard motor 2. Therefore, the first marine vessel propulsion apparatus 201 can be prevented from resonating.

Second Marine Vessel Propulsion Apparatus

Next, a second marine vessel propulsion apparatus including an electric motor fixed to the steering shaft will be described. In the description given below, components equivalent to those shown in FIG. 1 to FIG. 19 are provided with the same reference numerals as in FIG. 1, etc., and description thereof will be omitted.

Third Preferred Embodiment

Figure 20:
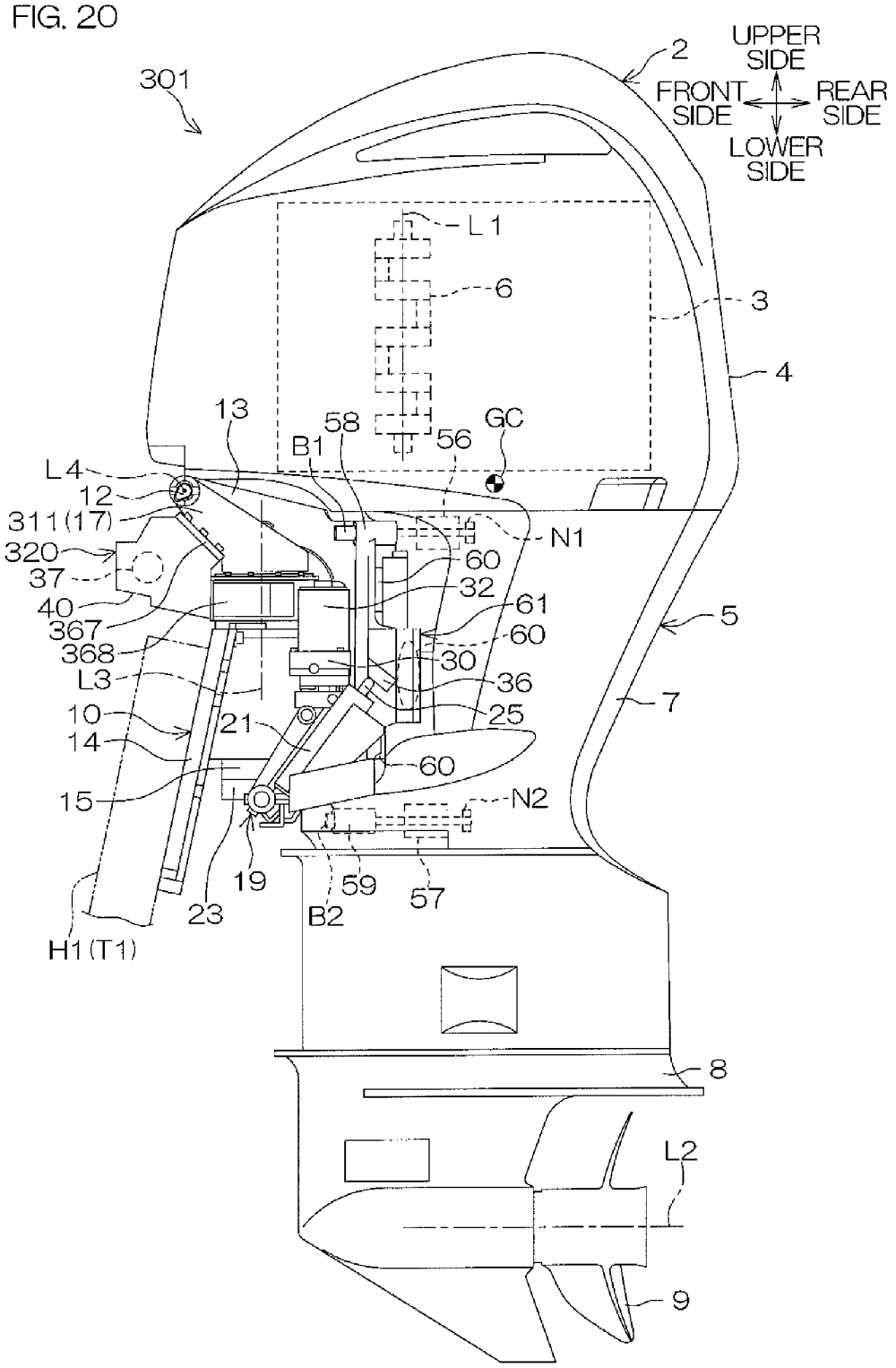
FIG. 20 is a side view of a second marine vessel propulsion apparatus according to a third preferred embodiment of the present invention.
Figure 21A:
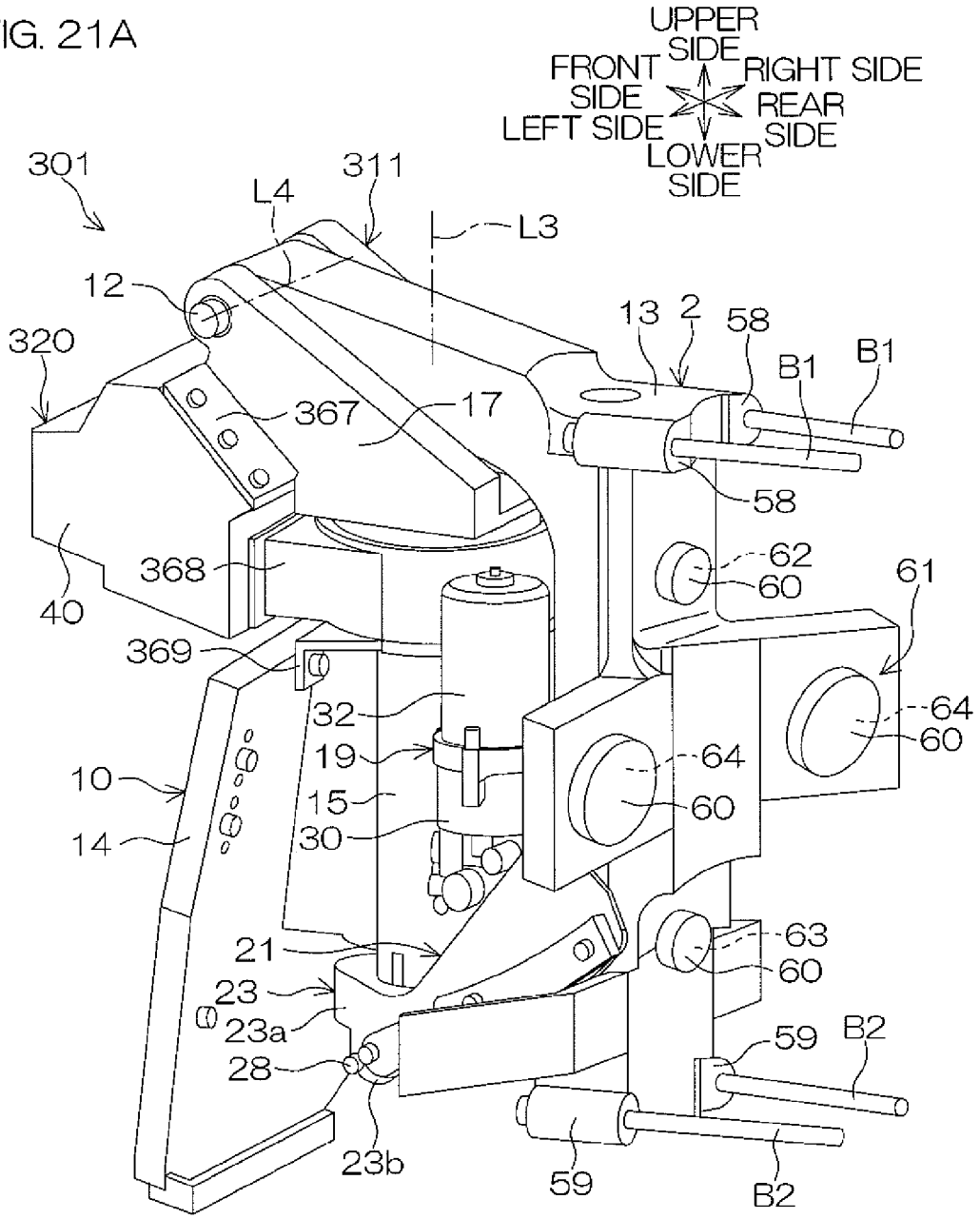
FIG. 21A is a perspective view of a portion of the second marine vessel propulsion apparatus according to the third preferred embodiment of the present invention.
Figure 21B:
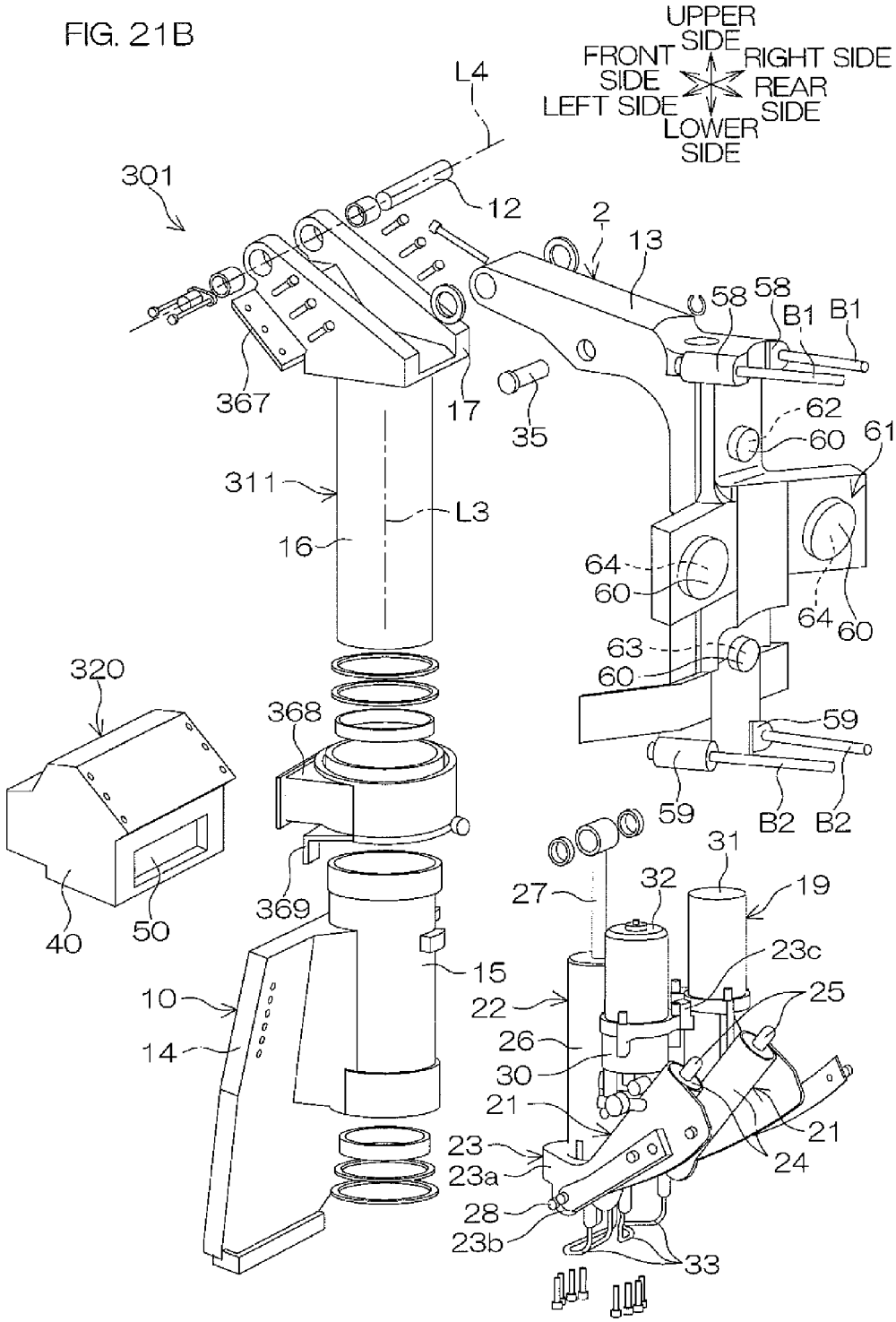
FIG. 21B is an exploded perspective view of a portion of the second marine vessel propulsion apparatus according to the third preferred embodiment of the present invention.
Figure 21C:
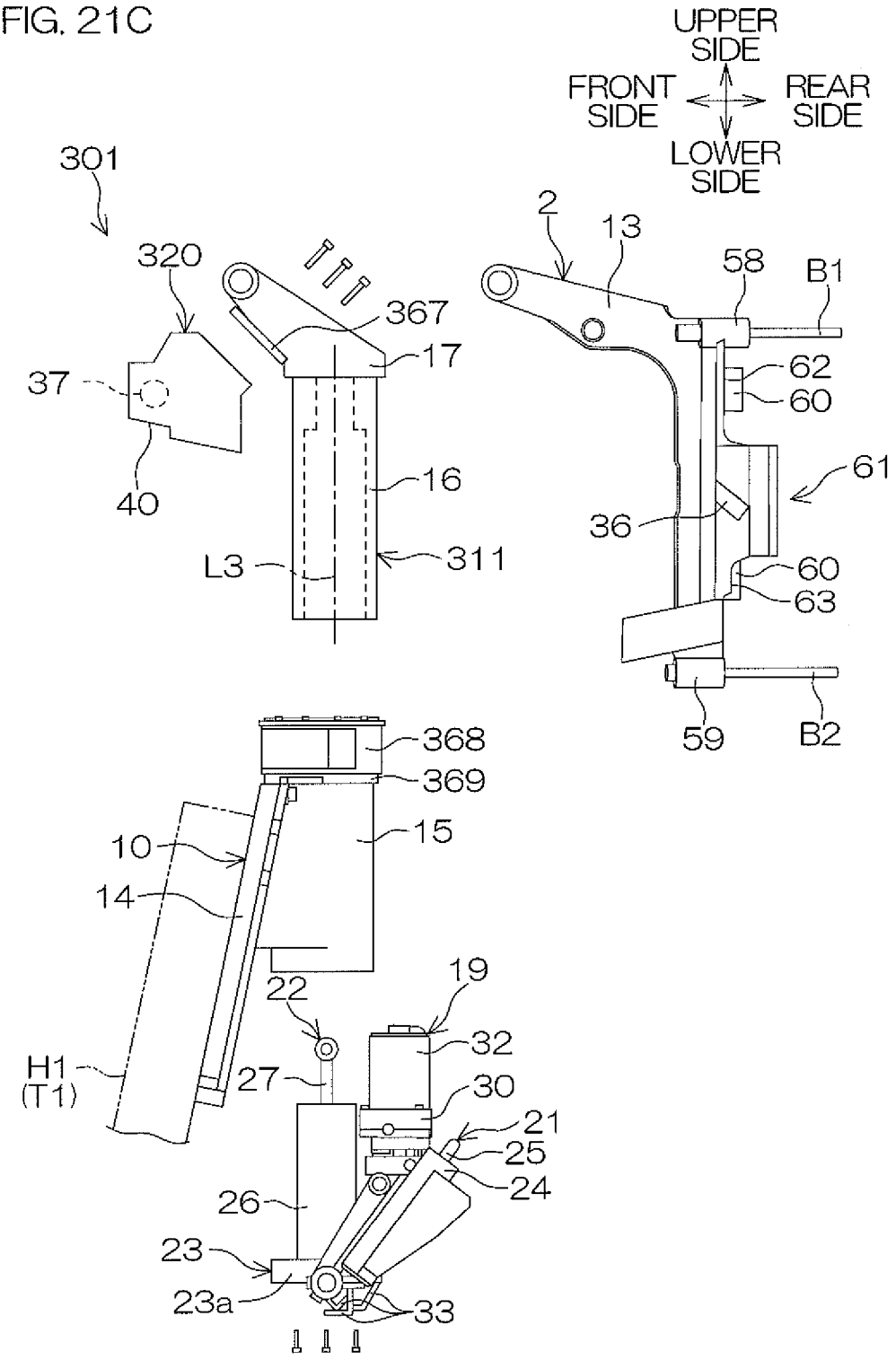
FIG. 21C is an exploded view of a portion of the second marine vessel propulsion apparatus according to the third preferred embodiment of the present invention.
Figure 22:
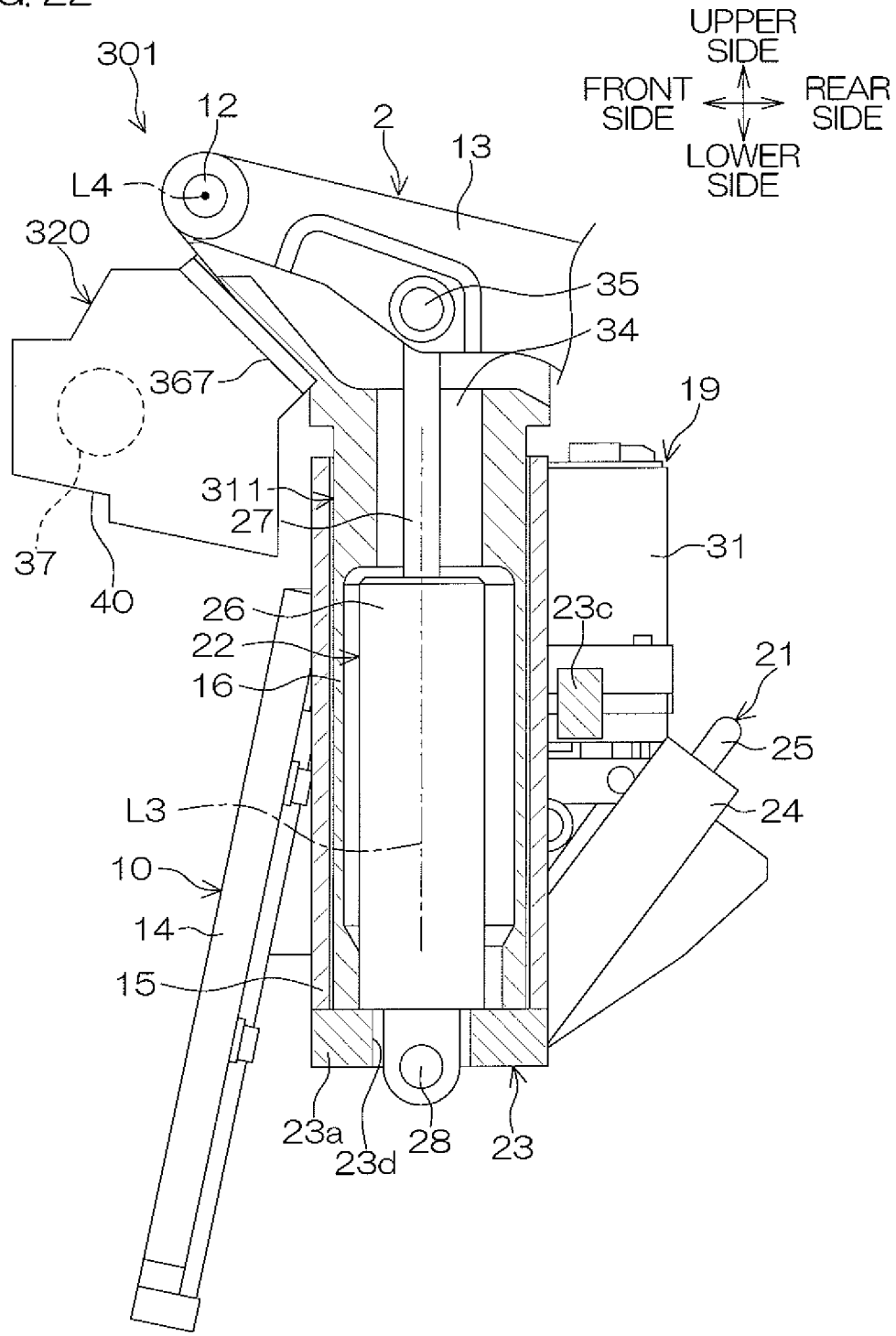
FIG. 22 is a partial sectional view of a portion of the second marine vessel propulsion apparatus according to the third preferred embodiment of the present invention.

FIG. 20 is a side view of a second marine vessel propulsion apparatus 301 according to a third preferred embodiment of the present invention. FIG. 21A is a perspective view of a portion of the second marine vessel propulsion apparatus 301 according to the third preferred embodiment of the present invention. FIG. 21B is an exploded perspective view of a portion of the second marine vessel propulsion apparatus 301 according to the third preferred embodiment of the present invention. FIG. 21C is an exploded view of a portion of the second marine vessel propulsion apparatus 301 according to the third preferred embodiment of the present invention. FIG. 22 is a partial side view of a portion of the second marine vessel propulsion apparatus 301 according to the third preferred embodiment of the present invention.

The second marine vessel propulsion apparatus 301 includes the outboard motor 2, the transom bracket 10, a steering shaft 311, the tilt shaft 12, and the tilt bracket 13. The second marine vessel propulsion apparatus 301 further includes the tilt mechanism 19 and a steering mechanism 320. The steering shaft 311 includes the tubular portion 16 and the joint portion 17. The joint portion 17 is joined to the upper end portion of the tubular portion 16. The joint portion 17 is, for example, integral with the tubular portion 16. The tubular portion 16 and the joint portion 17 may constitute an integral member, or may constitute a member including a plurality of divided bodies joined integrally. Specifically, the steering shaft 311 may be a member including a plurality of divided bodies, or may be an integral member. The inside of the tubular portion 16 is connected to the through-hole 34 of the joint portion 17. The cylinder main body 26 of the tilt cylinder 22 is dispersed inside the tubular portion 16. The lower end portion of the tubular portion 16 is joined to the frame 23. The upper end portion of the tilt rod 27 projects upward from the through-hole 34 of the joint portion 17. The upper end portion of the tilt rod 27 is joined to the tilt bracket 13 via the upper pin 35.

As shown in FIG. 20, the second marine vessel propulsion apparatus 301 includes two upper mounts 56 disposed at the same height at an interval in the right-left direction. Further, the second marine vessel propulsion apparatus 301 includes two lower mounts 57 disposed at the same height at an interval in the right-left direction. The tilt bracket 13 is joined to the outboard motor 2 via the upper mounts 56 and the lower mounts 57. The second marine vessel propulsion apparatus 301 includes a plurality of third mounts 60. The support portion 61 provided on the tilt bracket 13 supports the outboard motor 2 via the plurality of third mounts 60. A propulsive force generated by the outboard motor 2 is transmitted to the tilt bracket 13 via the mounts 56, 57, and 60. Accordingly, the hull H1 is propelled. Vibration of the outboard motor 2 is blocked by the mounts 56, 57, and 60. Accordingly, transmission of vibration of the outboard motor 2 to the hull H1 is minimized.

Figure 23:
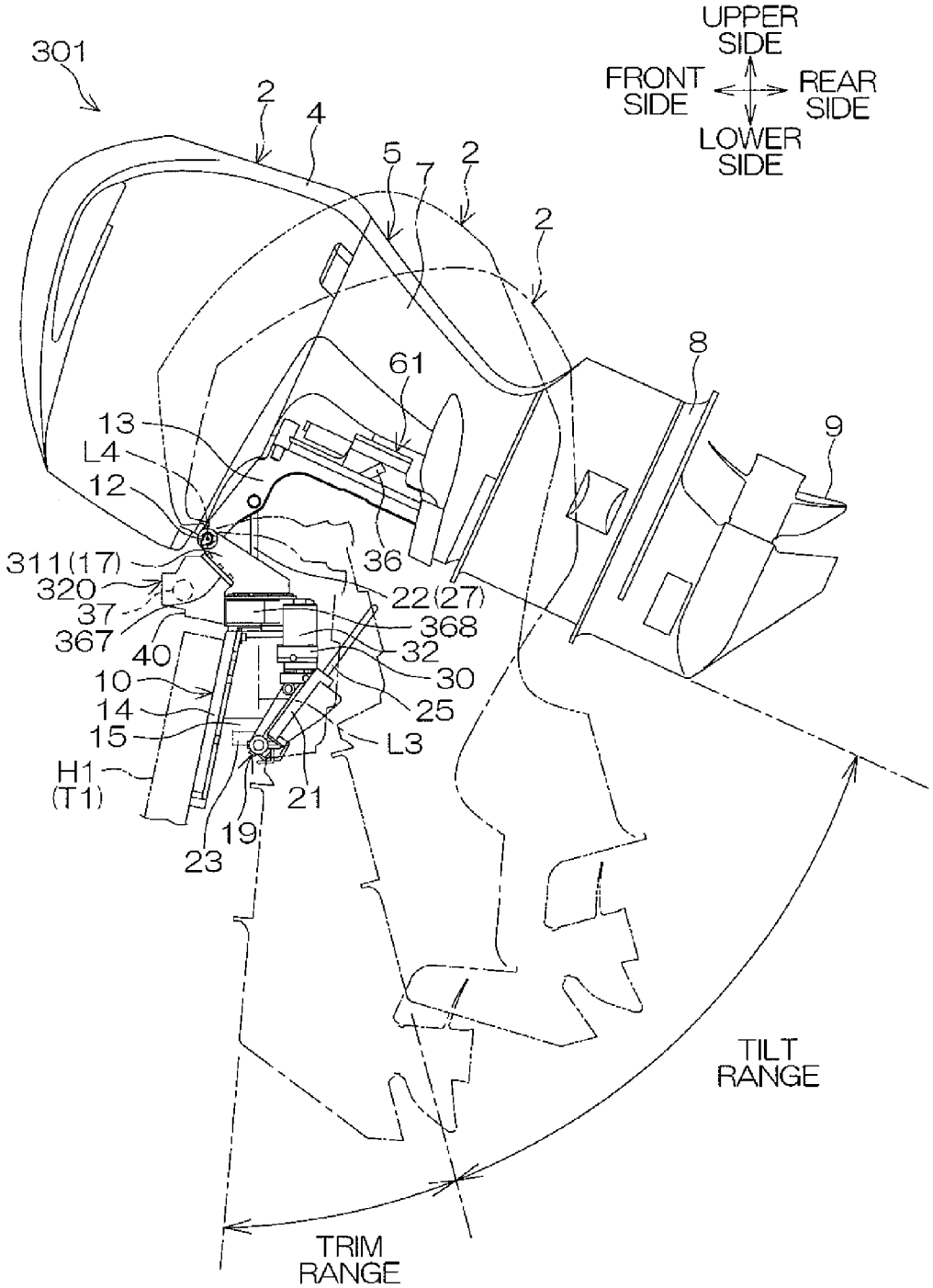
FIG. 23 is a side view of the second marine vessel propulsion apparatus according to the third preferred embodiment of the present invention.
Figure 24:
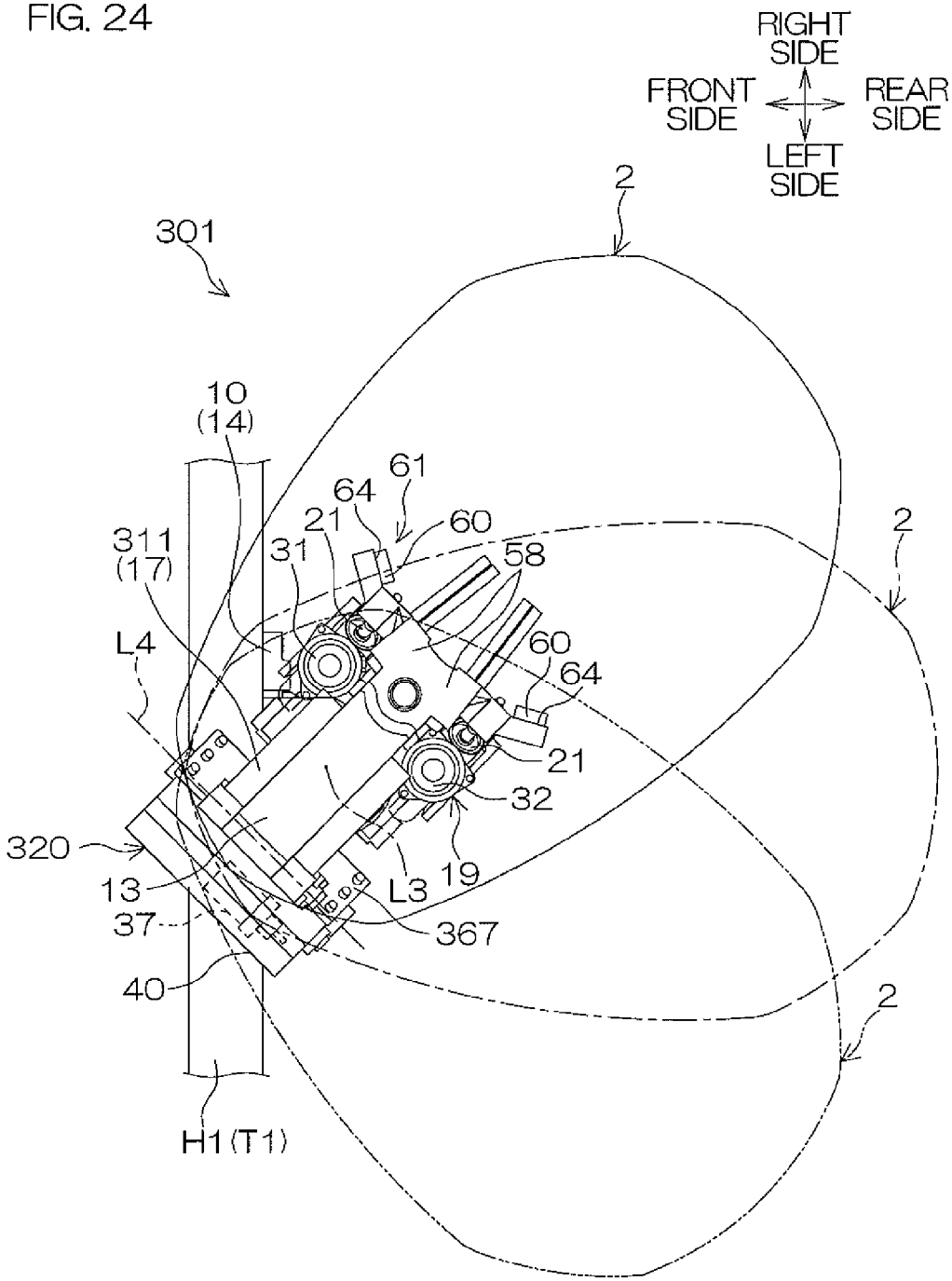
FIG. 24 is a plan view of the second marine vessel propulsion apparatus according to the third preferred embodiment of the present invention.

FIG. 23 is a side view of the second marine vessel propulsion apparatus 301 according to the second preferred embodiment of the present invention. FIG. 24 is a plan view of the second marine vessel propulsion apparatus 301 according to the second preferred embodiment of the present invention. FIG. 24 shows a state in which the outboard motor 2 is positioned at a maximum rightward steering position by the solid line. FIG. 24 shows a state in which the outboard motor 2 is positioned at the steering origin by alternate long and short dashed lines, and shows a state in which the outboard motor 2 is positioned at a maximum leftward steering position by the alternate long and two short dashed lines.

The steering shaft 311 further includes a fixing portion 367 provided on the joint portion 17. The steering case 40 is fixed to the fixing portion 367. Therefore, the electric motor 37 is fixed to the steering shaft 311 via the steering case 40. The outboard motor 2 turns around the tilt axis L4 with respect to the steering shaft 311. Therefore, as shown in FIG. 23, when the outboard motor 2 turns around the tilt axis L4 with respect to the transom bracket 10, the electric motor 37 does not turn around the tilt axis L4 with respect to the transom bracket 10. Specifically, when the outboard motor 2 turns around the tilt axis L4 with respect to the transom bracket 10, the position of the electric motor 37 with respect to the outboard motor 2 changes.

On the other hand, the electric motor 37 is fixed to the steering shaft 311, so that when the steering shaft 311 turns around the steering axis L3, the electric motor 37 turns around the steering axis L3 together with the steering shaft 311 and the outboard motor 2. Therefore, as shown in FIG. 24, when the outboard motor 2 turns around the steering axis L3 with respect to the transom bracket 10, the electric motor 37 turns around the steering axis L3 with respect to the transom bracket 10 together with the outboard motor 2. Specifically, even when the outboard motor 2 turns around the steering axis L3 with respect to the transom bracket 10, the position of the electric motor 37 with respect to the outboard motor 2 does not change.

Figure 25:
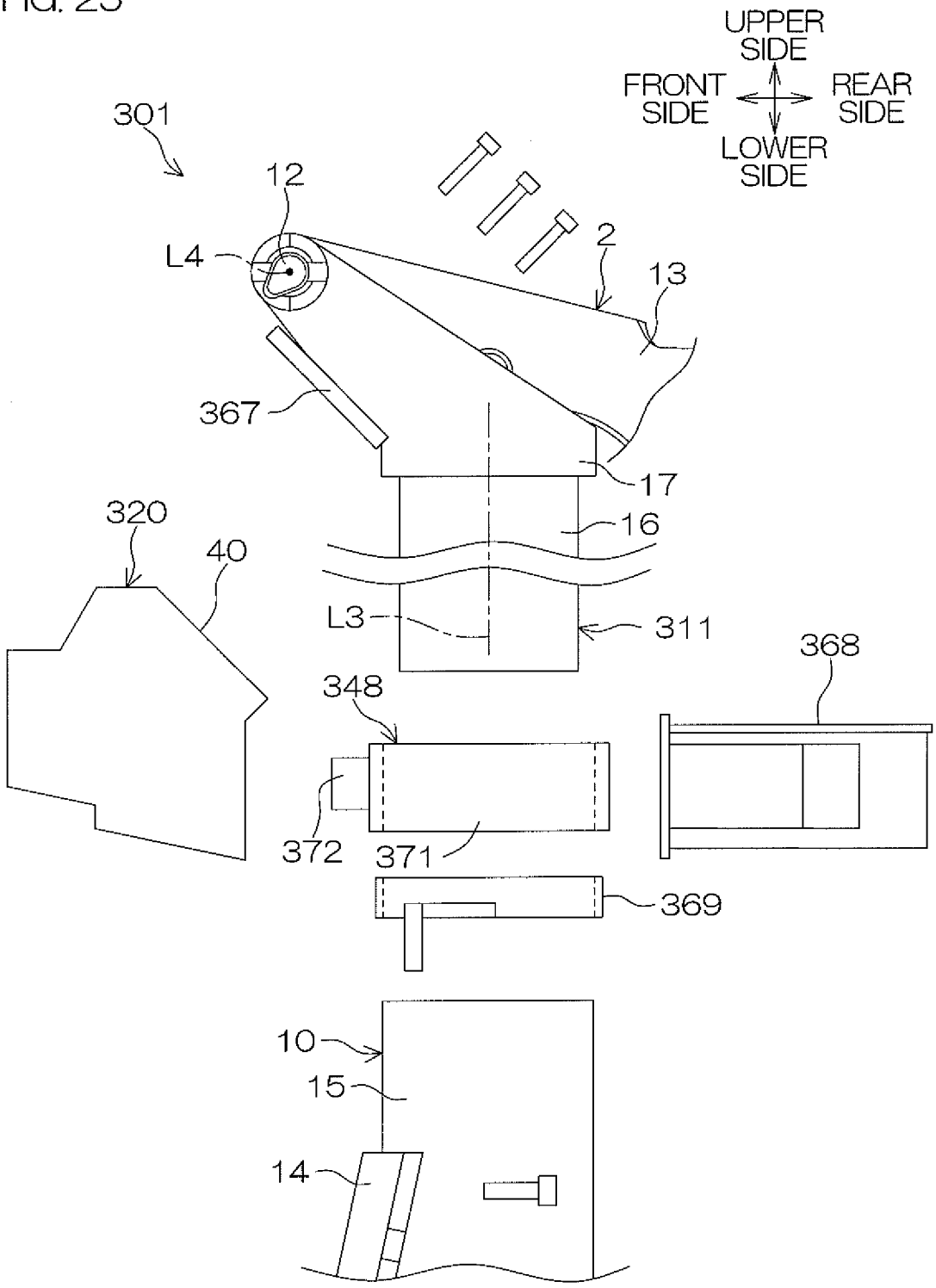
FIG. 25 is an exploded view of a portion of the second marine vessel propulsion apparatus according to the third preferred embodiment of the present invention.
Figure 26:
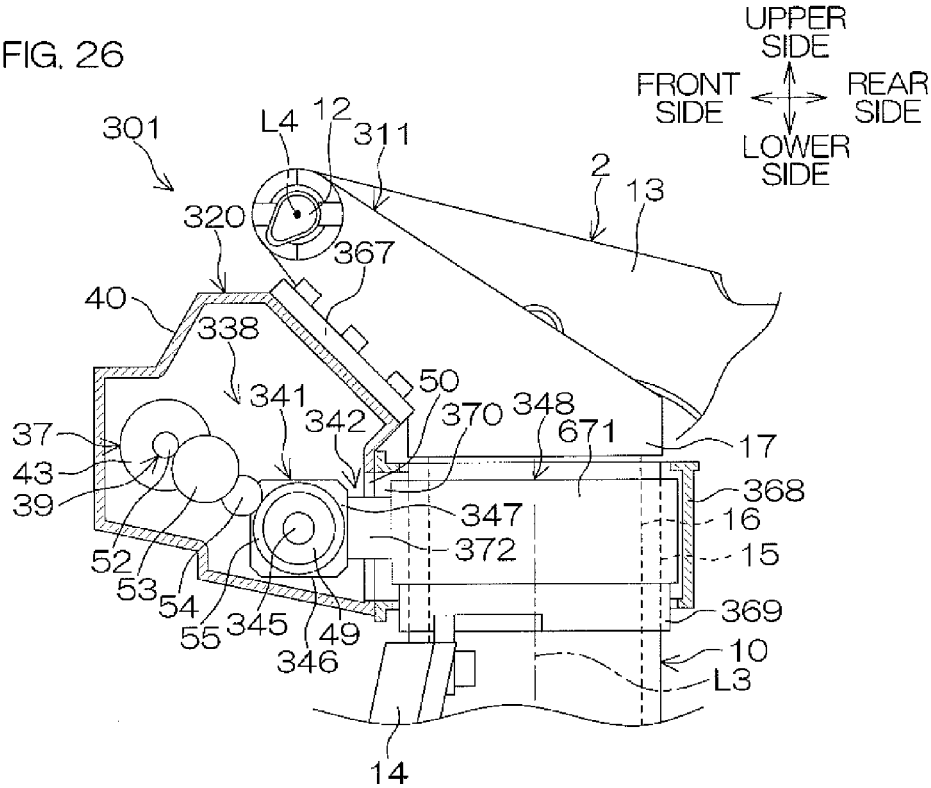
FIG. 26 is a partial sectional view of a portion of the second marine vessel propulsion apparatus including a steering mechanism according to the third preferred embodiment of the present invention.
Figure 27:
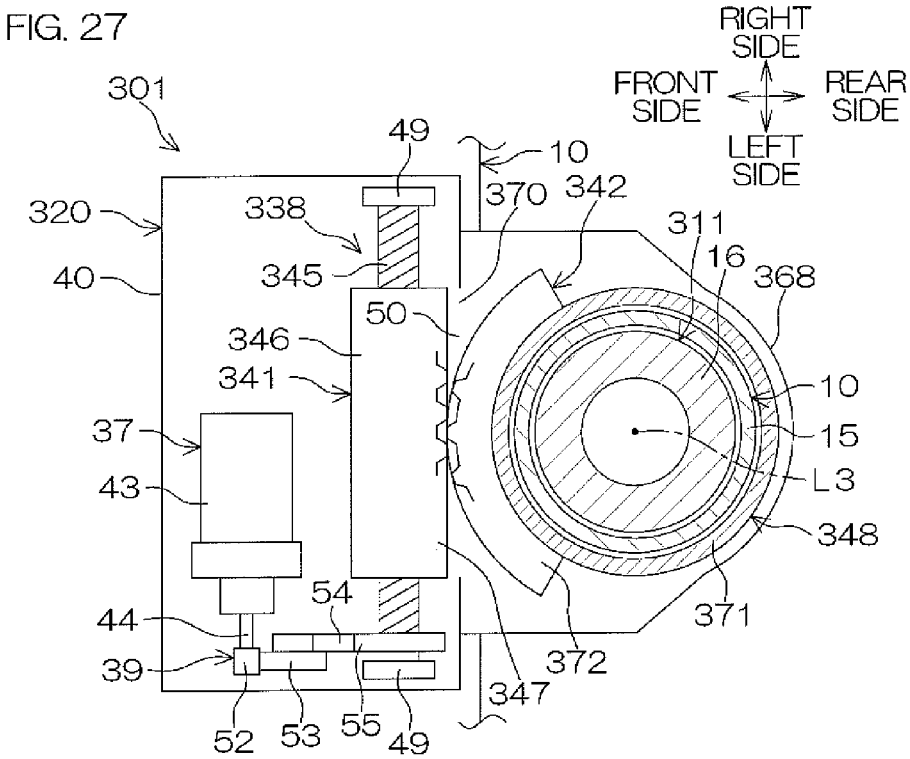
FIG. 27 is a schematic plan view of a portion of the second marine vessel propulsion apparatus including the steering mechanism according to the third preferred embodiment of the present invention.
Figure 28:
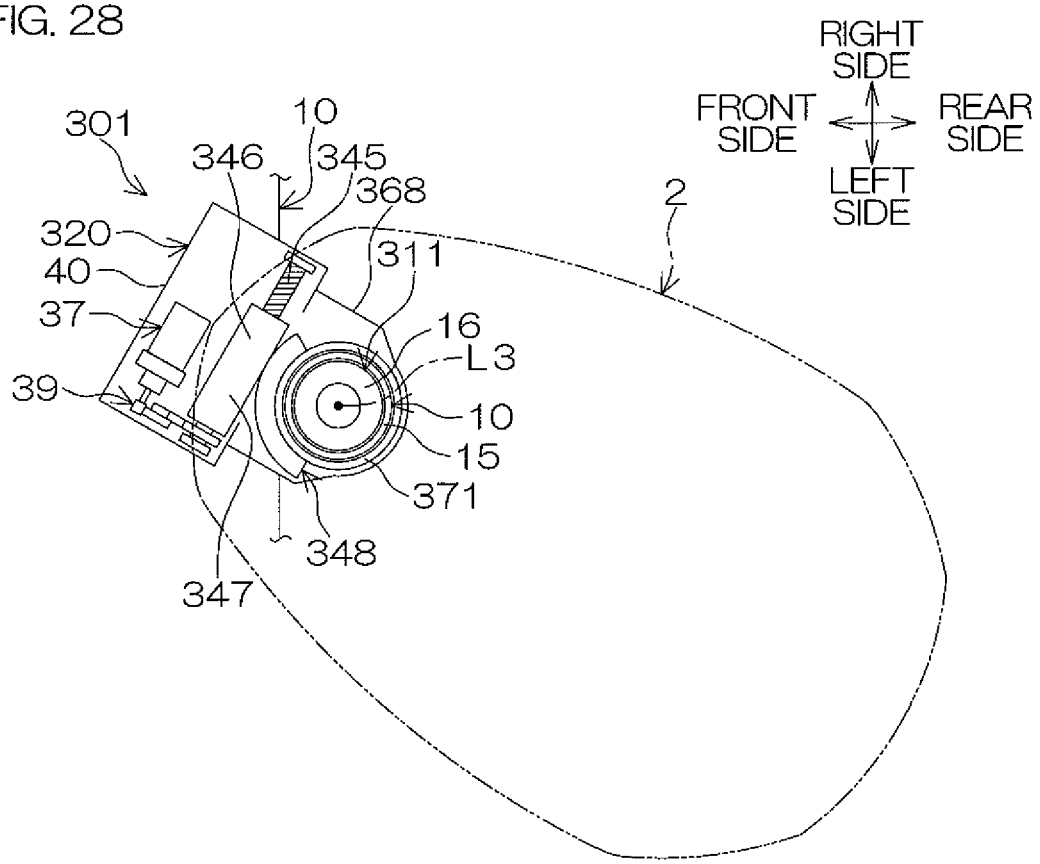
FIG. 28 is a schematic plan view of a portion of the second marine vessel propulsion apparatus including the steering mechanism according to the third preferred embodiment of the present invention.

FIG. 25 is an exploded view of a portion of the second marine vessel propulsion apparatus 301 according to the third preferred embodiment of the present invention. FIG. 26 is a partial sectional view of a portion of the second marine vessel propulsion apparatus 301 including a steering mechanism 320 according to the third preferred embodiment of the present invention. FIG. 27 and FIG. 28 are schematic plan views of a portion of the second marine vessel propulsion apparatus 301 including the steering mechanism 320 according to the third preferred embodiment of the present invention.

The steering mechanism 320 includes the electric motor 37, a power conversion mechanism 338, the reduction gear mechanism 39, and the steering case 40. As shown in FIG. 25, the steering mechanism 320 further includes a gear case 368 and a stay 369. The power conversion mechanism 338 includes a first conversion mechanism 341 and a second conversion mechanism 342. As shown in FIG. 26, the steering case 40 is fixed to a fixing portion 367 of the steering shaft 311, and the gear case 368 is fixed to the steering case 40. Therefore, the gear case 368 is fixed to the steering shaft 311 via the steering case 40. The steering shaft 311 is turnable around the steering axis L3 with respect to the transom bracket 10. Therefore, the gear case 368 is turnable around the steering axis L3 with respect to the transom bracket 10. As shown in FIG. 26, the gear case 368 has a gear opening 370 opposed to the steering opening 50. The inside of the steering case 40 is connected to the inside of the gear case 368 via the gear opening 370.

As shown in FIG. 27, the first conversion mechanism 341 includes a second ball screw 345, and a tubular second ball nut 346 attached to the second ball screw 345 via a plurality of balls. The second conversion mechanism 342 includes a second rack 347 joined to the second ball nut 346, and a second pinion 348 engaged with the second rack 347. The second ball screw 345, the second ball nut 346, and the second rack 347 are housed in the steering case 40, and held by the steering case 40. On the other hand, most of the second pinion 348 is housed in the gear case 368. The second pinion 348 is joined to the transom bracket 10. The steering shaft 311 is turnable around the steering axis L3 with respect to the transom bracket 10, so that the steering shaft 311 is turnable around the steering axis L3 with respect to the second pinion 348.

As shown in FIG. 27, the second ball screw 345 extends in the right-left direction inside the steering case 40. The rotational axis of the second ball screw 345 and the rotational axis of the electric motor 37 are parallel or substantially parallel to each other. The second ball screw 345 is disposed rearward relative to the electric motor 37. Both end portions of the second ball screw 345 are supported on the steering case 40 via bearings 49. The second ball screw 345 is joined to the transom bracket 10 via the steering case 40, and joined to the electric motor 37 via the reduction gear mechanism 39. The rotation of the electric motor 37 is transmitted to the second ball screw 345 via the reduction gear mechanism 39. Accordingly, the second ball screw 345 is driven to rotate by the electric motor 37. When the second ball screw 345 rotates around the central axis of the second ball screw 345, the second ball nut 346 moves along the second ball screw 345, and the rotation of the second ball screw 345 is converted into linear motion of the second ball nut 346 with respect to the second ball screw 345.

As shown in FIG. 27, the second rack 347 is provided on the outer peripheral portion of the second ball nut 346. The second rack 347 is, for example, integral with the second ball nut 346. The second rack 347 and the second ball nut 346 may constitute an integral member, or may constitute a member including a plurality of divided bodies joined integrally. The second rack 347 includes a plurality of teeth aligned in the axial direction of the second ball screw 345. The second rack 347 is opposed to the steering opening 50 provided in the steering case 40. When the second ball screw 345 rotates, the second rack 347 moves along the second ball screw 345 together with the second ball nut 346.

As shown in FIG. 27, the second pinion 348 includes a cylindrical portion 371 and a gear portion 372. As shown in FIG. 26, the cylindrical portion 371 of the second pinion 348 is fixed to the stay 369. The stay 369 is fixed to the transom bracket 10. Therefore, the second pinion 348 is fixed to the transom bracket 10 via the stay 369. The stay 369 is tubular. The stay 369 and the cylindrical portion 371 are disposed coaxially with each other. The inside of the stay 369 is connected to the inside of the cylindrical portion 371. As shown in FIG. 26, the housing portion 15 of the transom bracket 10 is inserted into the cylindrical portion 371 and the stay 369. The housing portion 15 penetrates through the cylindrical portion 371 and the stay 369 in the up-down direction. Therefore, the cylindrical portion 371 and the stay 369 surround the housing portion 16 around the steering axis L3.

As shown in FIG. 26 and FIG. 27, the second pinion 348 is covered by the gear case 368. The gear case 368 is disposed around the second pinion 348. The gear portion 372 of the second pinion 348 projects from the outer peripheral portion of the cylindrical portion 371. The gear portion 372 has, for example, a fan shape having a central axis positioned on the steering axis L3. The gear portion 372 enters the inside of the steering case 40 through the steering opening 50 and the gear opening 370. The gear portion 372 engages with the second rack 347 inside the steering case 40. The rotation of the electric motor 37 is converted into turning of the steering shaft 311 around the steering axis L3 by the second ball screw 345, the second ball nut 346, the second rack 347, and the second pinion 348.

In detail, the rotation of the electric motor 37 is transmitted to the second ball screw 345 by the reduction gear mechanism 39. When the second ball screw 345 rotates, a force of relative movement in the axial direction of the second ball screw 345 is applied to the second ball screw 345 and the second ball nut 346. According to movement of the position of engagement between the second rack 347 and the second pinion 348, the force is converted into a force that turns the second ball screw 345 and the second ball nut 346 around the steering axis L3. Accordingly, as shown in FIG. 28, the second ball screw 345 and the second ball nut 346 turn around the steering axis L3 while the second ball screw 345 moves in the axial direction of the second ball screw 345 with respect to the second ball nut 346.

The second ball screw 345 is joined to the steering shaft 311 via the steering case 40. Therefore, the second ball screw 345 turns around the steering axis L3, and accordingly, the steering shaft 311 turns around the steering axis L3 with respect to the transom bracket 10. Specifically, the rotation of the electric motor 37 is converted into linear motion of the second ball nut 346 with respect to the second ball screw 345 by the second ball screw 345 and the second ball nut 346. Concurrently, the linear motion of the second ball nut 346 is converted into turning of the steering shaft 311 around the steering axis L3 by the second rack 347 and the second pinion 348. Accordingly, as shown in FIG. 28, the outboard motor 2 turns around the steering axis L3 with respect to the transom bracket 10.

Other Preferred Embodiments

Although preferred embodiments of the present invention are described above, the present invention is not limited to the contents of the above-described first to third preferred embodiments, and can be variously changed within the scope described in the claims.

For example, the above-described first to third preferred embodiments describe a case where the third mounts are preferably held on the tilt bracket. However, the third mounts may be held on the outboard motor, or may be held on both of the tilt bracket and the outboard motor.

Figure 29:
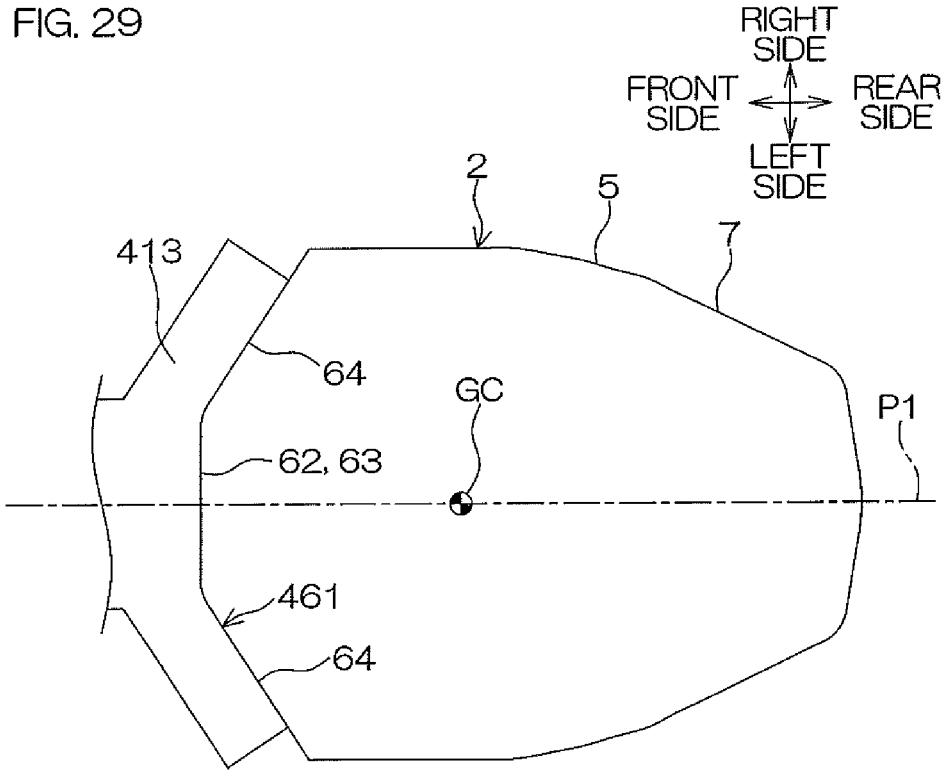
FIG. 29 is a schematic plan view for describing a supported state of an outboard motor according to a fourth preferred embodiment of the present invention.

The above-described first to third preferred embodiments describe a case where the support portion preferably supports the outboard motor via the plurality of third mounts. However, like the support portion 461 provided on the tilt bracket 413 shown in FIG. 29, the support portion may directly support the outboard motor without the third mounts.

Further, the above-described first to third preferred embodiments describe a case where the third mounts are preferably in contact with the outboard motor even in an engine stopped state, that is, a state in which the propeller does not rotate and the outboard motor does not vibrate. However, the third mounts may be arranged to be opposed to the casing via a space in an engine stopped state, and come into contact with the outboard motor when the outboard motor generates a forward propulsive force or vibrates.

In detail, when the outboard motor generates a forward propulsive force that propels the marine vessel forward, or the outboard motor vibrates, the upper mounts and the lower mounts are elastically deformed, and the outboard motor and the tilt bracket come close to each other. When the forward propulsive force or vibration further increases, the outboard motor and the tilt bracket come closer to each other. Therefore, the third mounts may be opposed to the casing via a space so that the third mounts come into contact with the casing when the outboard motor and the tilt bracket come close to each other. It is also possible that, in an engine stopped state, at least one third mount is in contact with the casing, and at least one third mount is opposed to the casing via a space.

The above-described first to third preferred embodiments describe a case where all of the third mounts are preferably held on the tilt bracket. However, it is also possible that all of the third mounts are held on the outboard motor. It is also possible that at least one third mount is held on the tilt bracket, and at least one third mount is held on the outboard motor.

The above-described first to third preferred embodiments describe a case where the third mounts preferably are a block type. However, the third mounts may be, for example, a bush type. Specifically, the third mount 60 shown in FIG. 30 and FIG. 31 may be provided in the first marine vessel propulsion apparatus and the second marine vessel propulsion apparatus.

Figure 30:
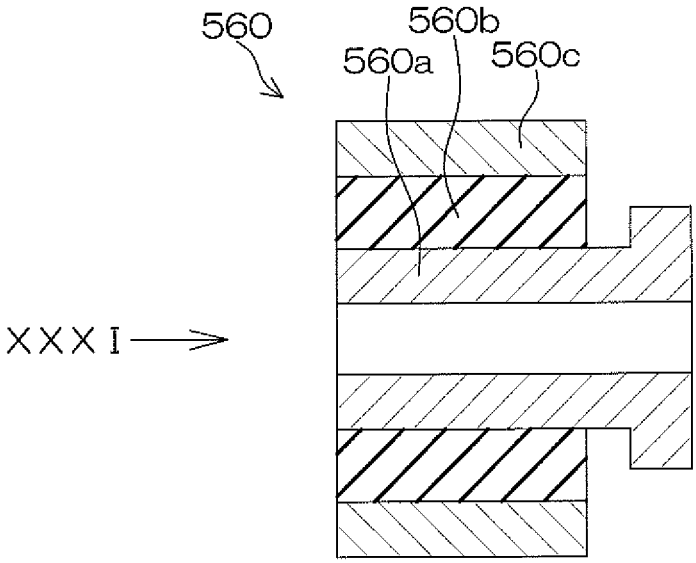
FIG. 30 is a sectional view of a third mount according to a fifth preferred embodiment of the present invention.
Figure 31:
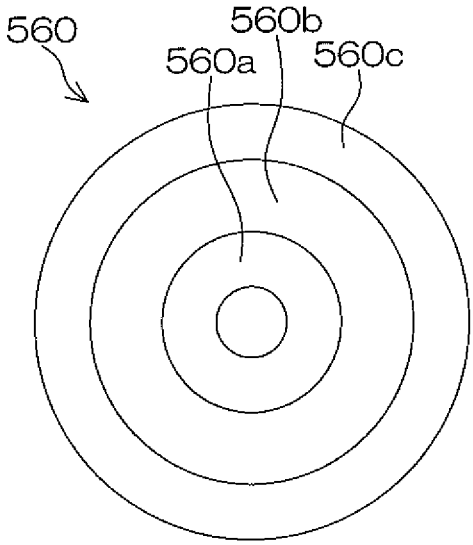
FIG. 31 is a plan view of the third mount viewed in a direction shown by the arrow XXXI in FIG. 30.

As shown in FIG. 30 and FIG. 31, the third mount 560 is cylindrical. The third mount 560 includes an inner tube 560*a*, an outer tube 560*c*, and a tubular elastic member 560*b*. The elastic member 560*b* surrounds the inner tube 560*a* around the central axis of the third mount 560, and the outer tube 560*c* surrounds the elastic member 560*b* around the central axis of the third mount 560. The elastic member 560*b* is coupled to the outer peripheral surface of the inner tube 560*a* and the inner peripheral surface of the outer tube 560*c*. The outer peripheral surface of the outer tube 560*c* is held on the tilt bracket 13 or 213, and the outboard motor 2 is supported by the tip end portion of the inner tube 560*a* projecting from the outer tube 560*c* and the elastic member 560*b* although this is not shown.

The above-described first to third preferred embodiments describe a case where the steering mechanism preferably is an electric steering mechanism including an electric motor. However, the steering mechanism is not limited to an electric steering mechanism, but may be a hydraulic steering mechanism including a hydraulic pump.

The above-described third preferred embodiment describes a case where the second marine vessel propulsion apparatus includes the tilt bracket according to the first preferred embodiment. However, the second marine vessel propulsion apparatus may include the tilt bracket according to the second preferred embodiment.

A non-limiting example of the correspondence between the components mentioned in the "SUMMARY OF THE INVENTION" and the components of the above-described preferred embodiments are as follows.

Outboard motor: Outboard motor 2

Hull: Hull H1

Transom: Transom T1

Transom bracket: Transom bracket 10

Steering axis: Steering axis L3

Steering shaft: Steering shaft 11
First mount: Upper mounts 56
Second mount: Lower mounts 57
First joint portion: First joint portions 58
Second joint portion: Second joint portions 59
Support portion: Support portion 61, 261, 461
Tilt axis: Tilt axis L4
Tilt bracket: Tilt bracket 13, 213, 413
Tilt mechanism: Tilt mechanism 19
Steering mechanism: Steering mechanism 20
Marine vessel propulsion apparatus: First marine vessel propulsion apparatus 1, 201, Second marine vessel propulsion apparatus 301
Plane including steering axis and orthogonal or substantially orthogonal to tilt axis: Reference plane P1
Crankshaft: Crankshaft 6
Engine: Engine 3
Rear support portion: Lateral support portions 264
Front support portion: Upper support portion 62 and lower support portion 63
Gravity center of outboard motor: Gravity center GC of outboard motor
Lateral support portions: Lateral support portions 64, 264
Third mount: Third mounts 60, 560

The present application corresponds to Japanese Patent Application No. 2010-230853 filed in the Japan Patent Office on Oct. 13, 2010, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel propulsion apparatus comprising:

an outboard motor arranged to generate a propulsive force;

a transom bracket attachable to a transom of a hull;

a steering shaft joined to the transom bracket, the steering shaft being turnable around a steering axis extending in an up-down direction;

a first mount having elasticity;

a second mount having elasticity and disposed lower than the first mount;

a tilt bracket including a first joint portion joined to the outboard motor via the first mount, a second joint portion joined to the outboard motor via the second mount, and a support portion arranged to contact and support the outboard motor at a height different from heights of the first mount and the second mount, the tilt bracket being joined to the steering shaft, the tilt bracket being turnable around a tilt axis extending horizontally along a right-left direction together with the outboard motor, the tilt bracket being turnable around the steering axis together with the steering shaft and the outboard motor;

a tilt mechanism joined to the steering shaft and the tilt bracket, the tilt mechanism arranged to turn the tilt bracket around the tilt axis with respect to the steering shaft; and a steering mechanism joined to the transom bracket and the steering shaft, the steering mechanism arranged to turn the steering shaft around the steering axis with respect to the transom bracket; wherein the support portion is arranged to contact and support the outboard motor in a direction obliquely inclined with respect to a front-rear direction of the marine vessel propulsion apparatus.

2. The marine vessel propulsion apparatus according to claim 1, wherein the support portion is arranged to support the outboard motor at a height between the first mount and the second mount.

3. The marine vessel propulsion apparatus according to claim 1, wherein the support portion is symmetrical about a plane including the steering axis and orthogonal or substantially orthogonal to the tilt axis.

4. The marine vessel propulsion apparatus according to claim 1, further comprising a front support portion, wherein the outboard motor includes an engine including a crankshaft, and the support portion includes a rear support portion arranged to support the outboard motor on a side rearward relative to the crankshaft, and the front support portion is arranged to support the outboard motor on a side forward relative to the rear support portion.

5. The marine vessel propulsion apparatus according to claim 4, wherein the rear support portion is arranged to support the outboard motor on a side rearward relative to a gravity center of the outboard motor, and the front support portion is arranged to support the outboard motor on a side forward relative to the gravity center of the outboard motor.

6. The marine vessel propulsion apparatus according to claim 1, wherein the support portion includes a lateral support portion arranged to support the outboard motor at a position separate from the first mount and the second mount in the right-left direction.

7. The marine vessel propulsion apparatus according to claim 1, further comprising a third mount having elasticity, wherein the support portion is arranged to support the outboard motor via the third mount.

8. The marine vessel propulsion apparatus according to claim 1, wherein the support portion is arranged to contact and support the outboard motor at a position laterally outward of the first mount and the second mount in a left right-left direction of the marine vessel propulsion apparatus.

9. The marine vessel propulsion apparatus according to claim 1, wherein the outboard motor includes an engine and a casing disposed below the engine, and the support portion is arranged to contact and support the casing of the outboard motor.

* * * * *